US009264814B2

(12) United States Patent
Je et al.

(10) Patent No.: US 9,264,814 B2
(45) Date of Patent: Feb. 16, 2016

(54) MICROPHONE

(71) Applicant: Electronics and Telecommunications Research Institute, Daejeon (KR)

(72) Inventors: Chang Han Je, Daejeon (KR); Jaewoo Lee, Daejeon (KR); Woo Seok Yang, Daejeon (KR); Jong-Kee Kwon, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 14/282,929

(22) Filed: May 20, 2014

(65) Prior Publication Data

US 2015/0146906 A1 May 28, 2015

(30) Foreign Application Priority Data

Nov. 27, 2013 (KR) ..... 10-2013-0145340

(51) Int. Cl.
*H04R 9/08* (2006.01)
*H04R 7/02* (2006.01)
*H04R 19/04* (2006.01)

(52) U.S. Cl.
CPC . *H04R 7/02* (2013.01); *H04R 19/04* (2013.01)

(58) Field of Classification Search
CPC ..... H04R 1/00; H04R 19/04; H04R 19/005
USPC ..... 381/170, 172, 174, 175, 355, 369, 173; 257/729, 708, 730
See application file for complete search history.

(56) References Cited

U.S. PATENT DOCUMENTS

| | | | | |
|---|---|---|---|---|
| 8,415,717 | B2 | 4/2013 | Lee et al. | |
| 2007/0286438 | A1* | 12/2007 | Hirade et al. | 381/175 |
| 2011/0075865 | A1* | 3/2011 | Yang | H04R 19/005 381/174 |
| 2012/0319174 | A1* | 12/2012 | Wang | B81C 1/00246 257/254 |
| 2013/0044899 | A1 | 2/2013 | Barber et al. | |
| 2014/0133685 | A1* | 5/2014 | Liu et al. | 381/355 |

OTHER PUBLICATIONS

David T. Martin et al., "A Micromachined Dual-Backplate Capacitive Microphone for Aeroacoustic Measurements", Journal of Microelectromechanical Systems, Dec. 2007, pp. 1289-1302, vol. 16, No. 6.

Pirmin Rombach et al., "The first low voltage, low noise differential silicon microphone technology development and measurement results", Sensors and Actuators A, 2002, pp. 196-201, vol. 95.

* cited by examiner

*Primary Examiner* — Brian Ensey
*Assistant Examiner* — Julie X Dang

(57) ABSTRACT

Provided is a microphone. The microphone includes a substrate including an acoustic chamber, a lower backplate disposed on the substrate, a diaphragm spaced apart from the lower backplate on the lower backplate, the diaphragm having a diaphragm hole passing therethrough, a connection unit disposed on the lower backplate to extend through the diaphragm hole, and an upper backplate disposed on the connection unit, the upper backplate being spaced apart from the diaphragm. Thus, the microphone may be improved in sensitivity and reliability.

17 Claims, 25 Drawing Sheets

MICROPHONE

CROSS-REFERENCE TO RELATED APPLICATIONS

This U.S. non-provisional patent application claims priority under 35 U.S.C. §119 of Korean Patent Application No. 10-2013-0145340, filed on Nov. 27, 2013, the entire contents of which are hereby incorporated by reference.

BACKGROUND OF THE INVENTION

The present invention relates to a micro device using a micro electro mechanical system (MEMS) technology, and more particularly, to a condenser-type MEMS microphone.

Microphones are apparatuses for converting voices into electrical signals. In recent, as the development of wire-wireless equipment is accelerated, a microphone is gradually decreasing in size. Thus, microphones using MEMSs have been developed in recent years.

Such a microphone may be largely classified into a piezo-type microphone and a condenser-type microphone. The piezo-type microphone may use a piezo effect in which a potential difference occurs between both ends of a piezoelectric material when a physical pressure is applied to the piezo-electric material. Here, a pressure of a voice signal may be converted into an electrical signal. The piezo-type microphone has many limitations in application due to a low bandwidth and a uniform characteristic of a voice band frequency. The condenser-type microphone may use a principle of a condenser of which two electrodes face each other. Here, one electrode of the microphone may be fixed, and the other electrode may serve as a diaphragm. This is, when the diaphragm is vibrated by a pressure of a voice signal, a capacitance between the two electrodes may be changed to change a condensed charge, and thus, current may flow. The condenser-type microphone may have stability and superior frequency characteristic. Thus, the condenser-type microphone is being widely used as the microphone.

SUMMARY OF THE INVENTION

The present invention provides a microphone having improved hardness.

The present invention also provides a microphone having improved sensitivity.

The object of the present invention is not limited to the aforesaid, but other objects not described herein will be clearly understood by those skilled in the art from descriptions below.

Embodiments of the present invention provide microphones including: a substrate including an acoustic chamber; a lower backplate disposed on the substrate; a diaphragm spaced apart from the lower backplate on the lower backplate, the diaphragm having a diaphragm hole passing therethrough; a connection unit disposed on the lower backplate to extend through the diaphragm hole; and an upper backplate disposed on the connection unit, the upper backplate being spaced apart from the diaphragm.

In some embodiments, a distance between the diaphragm and the lower backplate may be equal to that between the diaphragm and the upper backplate.

In other embodiments, the connection unit may have a width less than a diameter of the diaphragm hole.

In still other embodiments, the connection unit may be spaced apart from an inner sidewall of the diaphragm, and a gap may be defined between the connection unit and the inner sidewall of the diaphragm.

In even other embodiments, the lower backplate may have a lower hole passing therethrough, the upper backplate may have an upper hole passing therethrough, and the upper hole may be connected to the lower hole through the diaphragm hole.

In yet other embodiments, a lower gap may be defined between the lower backplate and an upper gap is defined the diaphragm and between the diaphragm and the upper backplate.

In further embodiments, the connection unit may be disposed at a position that corresponds to a core of the lower backplate.

In still further embodiments, the connection unit may include a conductive material, and an insulation layer may be disposed between the lower backplate and the connection unit or between the connection unit and the upper backplate.

In even further embodiments, the connection unit may include an insulating material.

In yet further embodiments, the acoustic chamber may be recessed from a top surface of the substrate toward a bottom surface of the substrate, and a bottom surface of the acoustic chamber may have a level greater than that of the substrate.

In much further embodiments, the microphones may further include a support disposed on the bottom surface of the acoustic chamber to extend toward the top surface of the substrate, wherein the lower backplate may be disposed on the support.

In other embodiments of the present invention, microphones include: a substrate including an acoustic chamber; a lower backplate disposed on the substrate; a diaphragm spaced apart from the lower backplate on the lower backplate, the diaphragm having a plurality of diaphragm holes passing therethrough; an upper backplate disposed above the diaphragm so that the upper backplate is spaced apart from the diaphragm; and connection units disposed between the lower backplate and the upper backplate to respectively pass through the diaphragm holes.

In some embodiments, each of the connection units may be a width less than a diameter of each of the diaphragm holes.

In other embodiments, the microphones may further include: a diaphragm support part extending from the diaphragm toward a bottom surface of the substrate to contact the substrate; and an upper backplate support part extending from the upper backplate toward the bottom surface of the substrate to cover a portion of the top surface of the substrate, wherein the upper backplate support part may be spaced apart from the diaphragm support part.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings:

FIGS. 6A to 9A are plan views illustrating a process of manufacturing a microphone according to an embodiment of the present invention;

FIGS. 6B to 9B are cross-sectional views for explaining a process of manufacturing the microphone according to an embodiment of the present invention, taken along line B-B' of FIGS. 6A to 9A; and FIGS. 6C to 9C are cross-sectional views for explaining a process of manufacturing the microphone according to an embodiment of the present invention, taken along line C-C' of FIGS. 6A to 9A.

DETAILED DESCRIPTION OF PREFERRED EMBODIMENTS

Figure 1A:
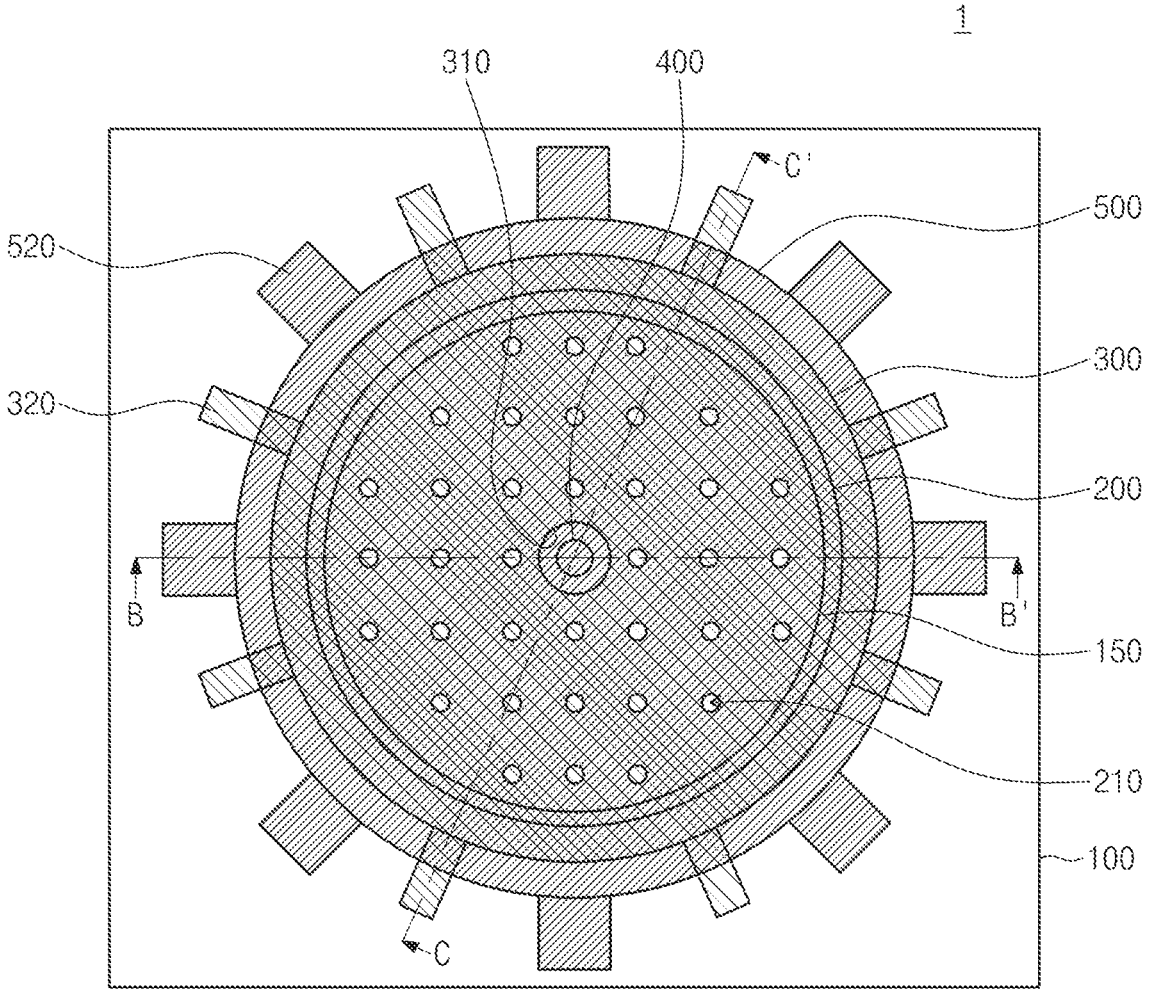
FIG. 1A is a plan view of a microphone according to an embodiment of the present invention.

Exemplary embodiments of the present invention will be described with reference to the accompanying drawings so as to sufficiently understand constitutions and effects of the present invention. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims. A person with ordinary skill in the technical field of the present invention pertains will be understood that the present invention can be carried out under any appropriate environments.

In the following description, the technical terms are used only for explaining a specific exemplary embodiment while not limiting the present invention. The terms of a singular form may include plural forms unless specifically mentioned. The meaning of 'comprises' and/or 'comprising' specifies a component, a step, an operation and/or an element does not exclude other components, steps, operations and/or elements.

In the specification, it will be understood that when a layer (or film) is referred to as being 'on' another layer or substrate, it can be directly on the other layer or substrate, or intervening layers may also be present.

Also, though terms like a first, a second, and a third are used to describe various regions and layers (or films) in various embodiments of the present invention, the regions and the layers are not limited to these terms. These terms are used only to discriminate one region or layer (or film) from another region or layer (or film). Therefore, a layer referred to as a first layer in one embodiment can be referred to as a second layer in another embodiment. An embodiment described and exemplified herein includes a complementary embodiment thereof. Like reference numerals in the drawings denote like elements.

Unless terms used in embodiments of the present invention are differently defined, the terms may be construed as meanings that are commonly known to a person skilled in the art.

Hereinafter, a microphone according to the present invention will be described with reference to the accompanying drawings.

Figure 1B:
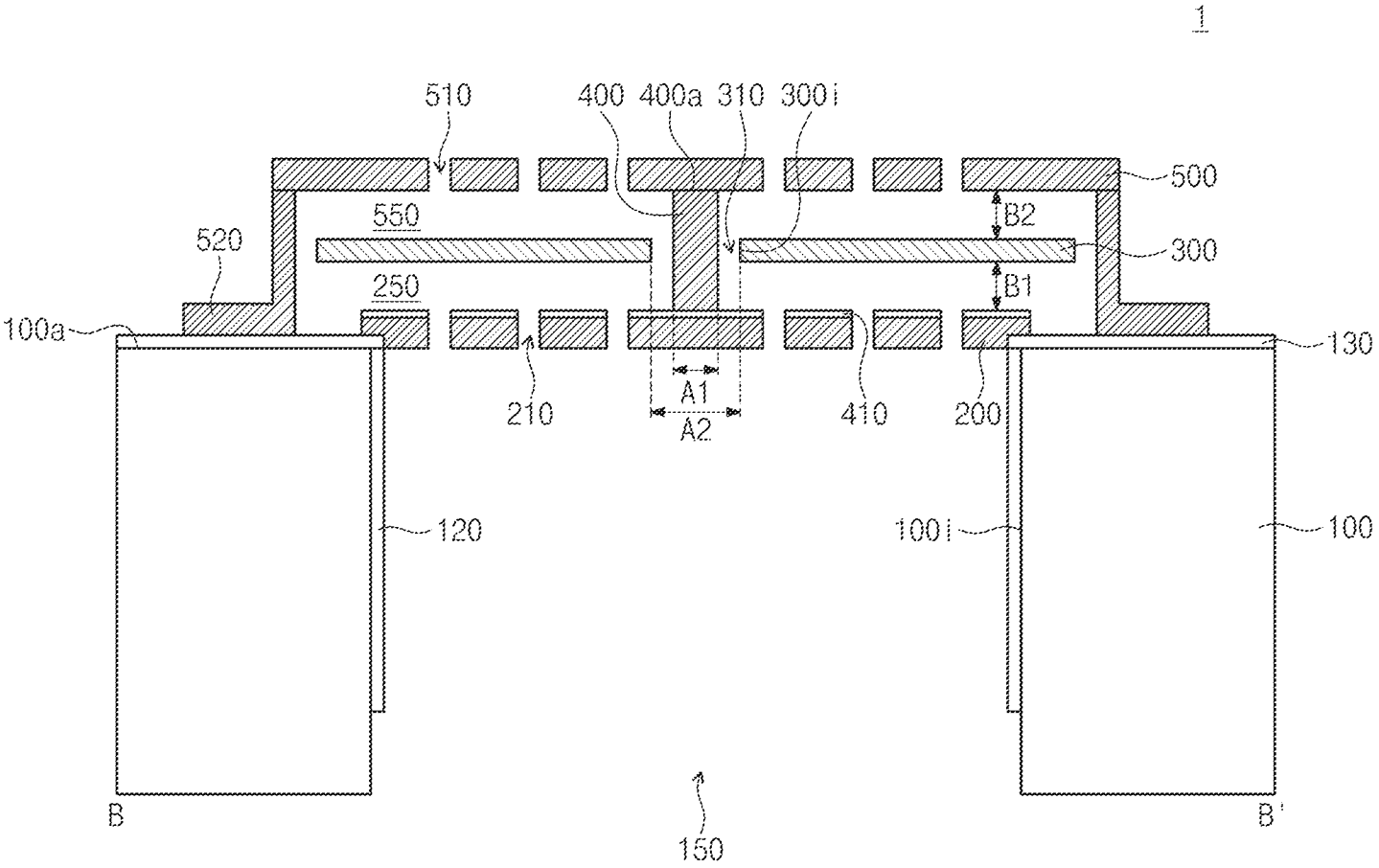
FIG. 1B is a cross-sectional view taken along line B-B' of FIG. 1A.
Figure 1C:
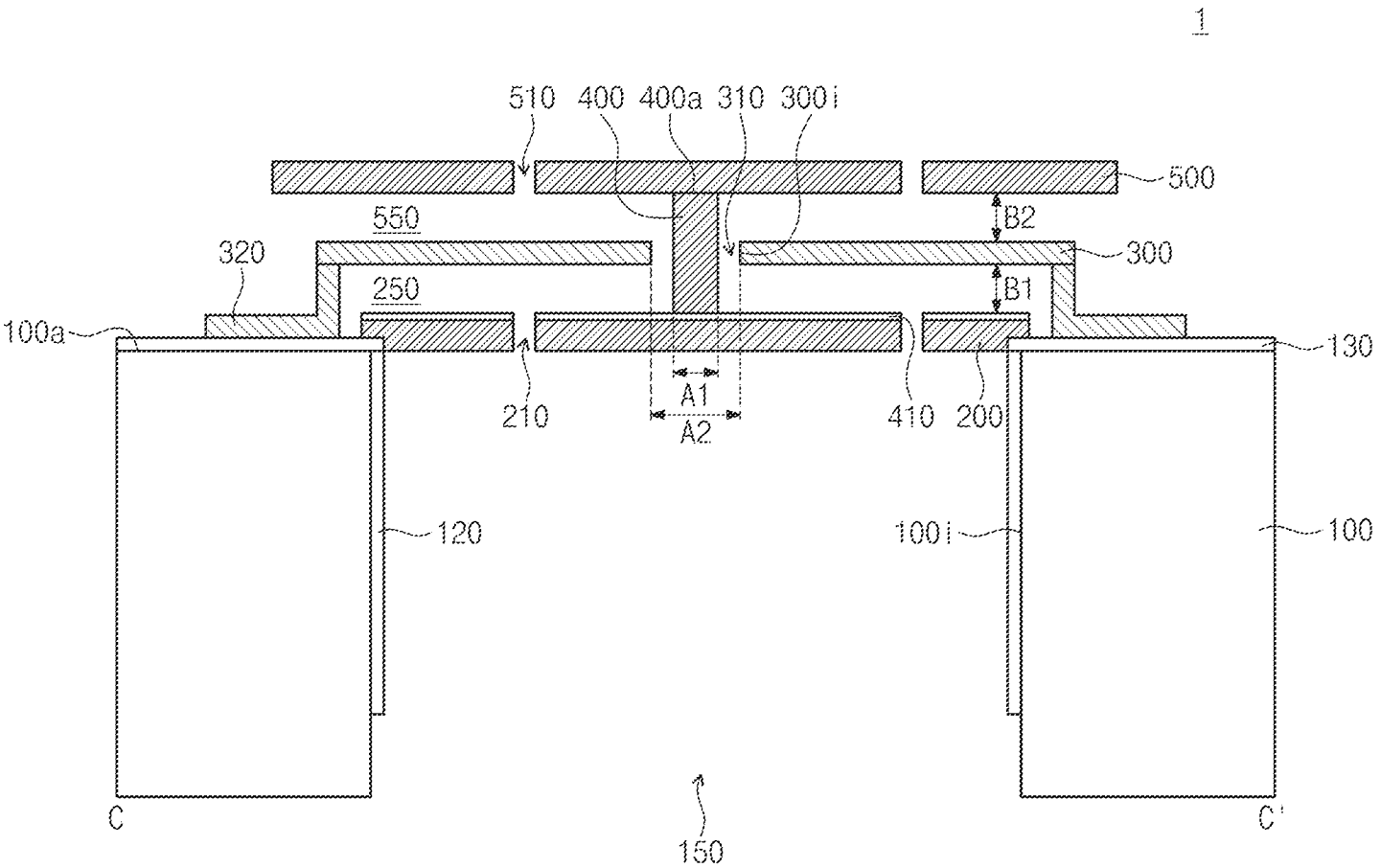
FIG. 1C is a cross-sectional view taken along line C-C' of FIG. 1A.

FIG. 1A is a plan view of a microphone according to an embodiment of the present invention. FIG. 1B is a cross-sectional view taken along line B-B' of FIG. 1A. FIG. 1C is a cross-sectional view taken along line C-C' of FIG. 1A.

Referring to FIGS. 1A to 1C, a microphone 1 may include a lower backplate 200, a diaphragm 300, a connection unit 400, and an upper backplate 500 which are disposed above a top surface 100*a* of a substrate 100.

The substrate 100 may include silicon or a compound semiconductor. The substrate 100 may have an acoustic chamber 150 passing therethrough. In view of plane, the acoustic chamber 150 may have a circular shape. The protection layer 120 may cover an inner surface 100*i* of the substrate 100 including the acoustic chamber 150. The protection layer 120 may include a material having etch selectivity with respect to the substrate 100, for example, an oxide or organic material. A substrate insulation layer 130 may cover a top surface 100*a* of the substrate 100. The substrate insulation layer 130 may include an organic material or oxide.

The lower backplate 200 may be disposed on the top surface 100*a* of the substrate 100. For example, the lower backplate 200 may be disposed on the acoustic chamber 150 to cover at least one portion of the substrate insulation layer 130. The lower backplate 200 may include a conductive material, for example, a metal or poly silicon. For example, the lower backplate 200 may include an insulating core part and a metal layer that is applied to both surfaces of the core part. For another example, the lower backplate 200 may be provided as a metal electrode layer. The lower backplate 200 may have a lower hole 210 passing therethrough. The lower hole 210 may be connected to the acoustic chamber 150. The substrate insulation layer 130 may be disposed between the substrate 100 and the lower backplate 200. The lower backplate 200 may be electrically insulated from the substrate 100 by the substrate insulation layer 130. As shown in FIG. 1A, in view of plane, the lower backplate 200 may have a circular shape. In the plane, the lower backplate 200 may have an area greater than that of the acoustic chamber 150. The lower hole 210 may overlap the acoustic chamber 150.

The diaphragm 300 may be disposed on the lower backplate 200. The diaphragm 300 may have a diaphragm hole 310 passing therethrough. The diaphragm 300 may include a conductive material, for example, a metal or poly silicon. As shown in FIG. 1A, in view of plane, the diaphragm 300 may have a circular shape. In the plane, the diaphragm 300 may have an area greater than that of the lower backplate 200. The diaphragm 300 may overlap the lower backplate 200. The diaphragm hole 310 may be defined in a position that corresponds to a core of the diaphragm 300. As shown in FIG. 1C, a diaphragm support part 320 may extend to the substrate 100 from the diaphragm to contact the substrate insulation layer 130. The diaphragm support part 320 may further extend along the top surface 100*a* of the substrate 100 to cover a portion of the substrate insulation layer 130. The diaphragm support part 320 may fix the diaphragm 300 to the substrate 100. The diaphragm support part 320 may include an elastic material or an elastic body. For example, the diaphragm support part 320 may include a spring. Thus, the diaphragm 300 may be vibrated by an external acoustic pressure. The diaphragm support part 320 may not overlap the lower backplate 200. A lower gap 250 may be defined between the lower backplate 200 and the diaphragm 300. The lower gap 250 may be connected to the lower hole 210. The diaphragm 300 may be spaced apart from the lower backplate 200 by the lower gap 250. The diaphragm 300 may be electrically insulated from the lower and upper backplates 200 and 500.

The connection unit 400 may be disposed on the lower backplate 200 to extend into the diaphragm hole 310. The connection unit 400 may have a width A1 less than a diameter A2 of the diaphragm hole 310. Thus, the connection unit 400 may be spaced apart from an inner surface 300*i* of the diaphragm 300. The lower gap 250 may be connected to an upper gap 550 through the diaphragm hole 310. For another example, the lower gap 250 may be connected to the upper gap 550 through a space between the diaphragm 300 and an upper backplate support part 520. The connection unit 400 may include a conductive material, for example, a metal or poly silicon. For example, the connection unit 400 may include a material that is equal or similar to that of the upper backplate 500. An insulation layer 410 may cover an entire top surface or a portion of a top surface of the lower backplate 200. For example, the insulation layer 410 may be disposed between the lower backplate 200 and the connection unit 400. The upper backplate 500 and the connection unit 400 may be electrically insulated from the lower backplate 200 by the insulation layer 410. The insulation layer 410 may be further provided between the lower backplate 200 and the lower gap 250. In this case, when the diaphragm 300 is operated, it may prevent the diaphragm 300 from being electrically connected to the lower backplate 200 by the insulation layer 410. For another example, the insulation layer 410 may not be provided between the lower backplate 200 and the lower gap 250.

The upper backplate 500 may be disposed on the diaphragm 300. The upper gap 550 may be provided between the diaphragm 300 and the upper backplate 500. The upper backplate 500 may be spaced apart from the diaphragm 300 by the upper gap 550. As shown in FIG. 1B, the upper backplate support part 520 may extend from an edge of the upper backplate 500 toward the top surface 100*a* of the substrate 100 to contact the substrate insulation layer 130. The upper backplate support part 520 may further extend along the top surface 100*a* of the substrate 100. As shown in FIG. 1A, in view of plane, the upper backplate 500 may have a circular shape. The upper backplate 500 may overlap the acoustic chamber 150. The upper backplate support part 520 may not overlap the diaphragm support part 320. For example, the upper backplate support part 520 and the diaphragm support part 320 may be alternately provided on the substrate 100.

The upper backplate 500 may have an upper hole passing therethrough. The upper hole 510 may connected to the acoustic chamber 150 through the upper gap 550, the lower gap 250, and the lower hole 210. The external acoustic pressure may be transmitted into the diaphragm 300 through the upper hole 510 and the upper gap 550. The external acoustic pressure transmitted into the diaphragm 300 may leak into the acoustic chamber 150 through the lower gap 250 and the lower hole 310. The microphone 1 according to the present invention may include the upper backplate 500 to improve sensitivity with respect to the vibration of the diaphragm 300 by the external acoustic pressure. For example, if the external acoustic pressure is not applied, a distance B2 between the diaphragm 300 and the upper plate 500 may be equal to that B1 between the diaphragm 300 and the lower backplate 200. The lower backplate 200 may have the same capacitance as the upper plate 500. When the diaphragm 300 is vibrated by the external acoustic pressure, the distance B2 between the diaphragm 300 and the upper backplate 500 may be different from that B1 between the lower backplate 200 and the diaphragm 300. Thus, the lower backplate 200 and the upper backplate 500 may have capacitances different from each other.

The upper backplate 500 may cover a top surface 400*a* of the connection unit 400. The connection unit 400 may prevent the upper backplate 500 from being deformed or damaged. The upper backplate 500 may be stably fixed to the lower backplate 200 by the connection unit 400. As the upper backplate 500 is stably fixed, the distance B2 between the diaphragm 300 and the upper backplate 500 may be equal to that B1 between the lower backplate 200 and the diaphragm 300. Thus, the microphone 1 may be improved in sensitivity and reliability.

As the upper backplate 500 is stably fixed to the substrate 100 and the lower backplate 200, the upper backplate 500 may be reduced in thickness. For example, the upper backplate 500 of the present invention may have a thickness of about 0.01 μm to about 1 μm. The lower backplate 200 may have a thickness equal or similar to that of the upper backplate 500. For example, the lower backplate 200 may have a thickness of about 0.01 μm to about 1 μm. As each of the backplates 200 and 500 decreases in thickness, the external acoustic pressure may pass through the diaphragm holes 310 and the gaps 250 and 550. Therefore, the microphone 1 may be improved in sensitivity and reliability.

Figure 2A:
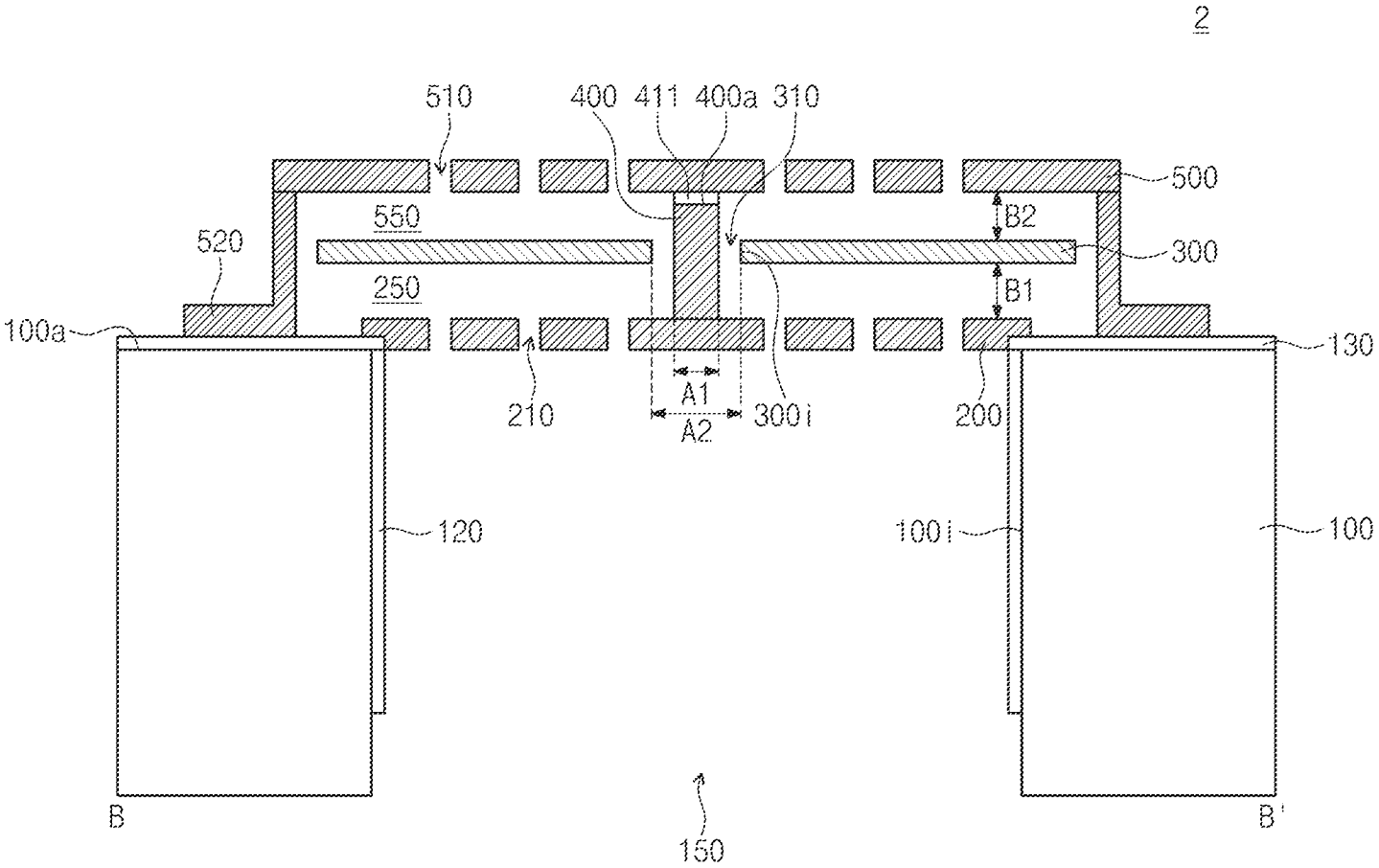
FIGS. 2A and 2B are cross-sectional views of a microphone according to another embodiment of the present invention.
Figure 2B:
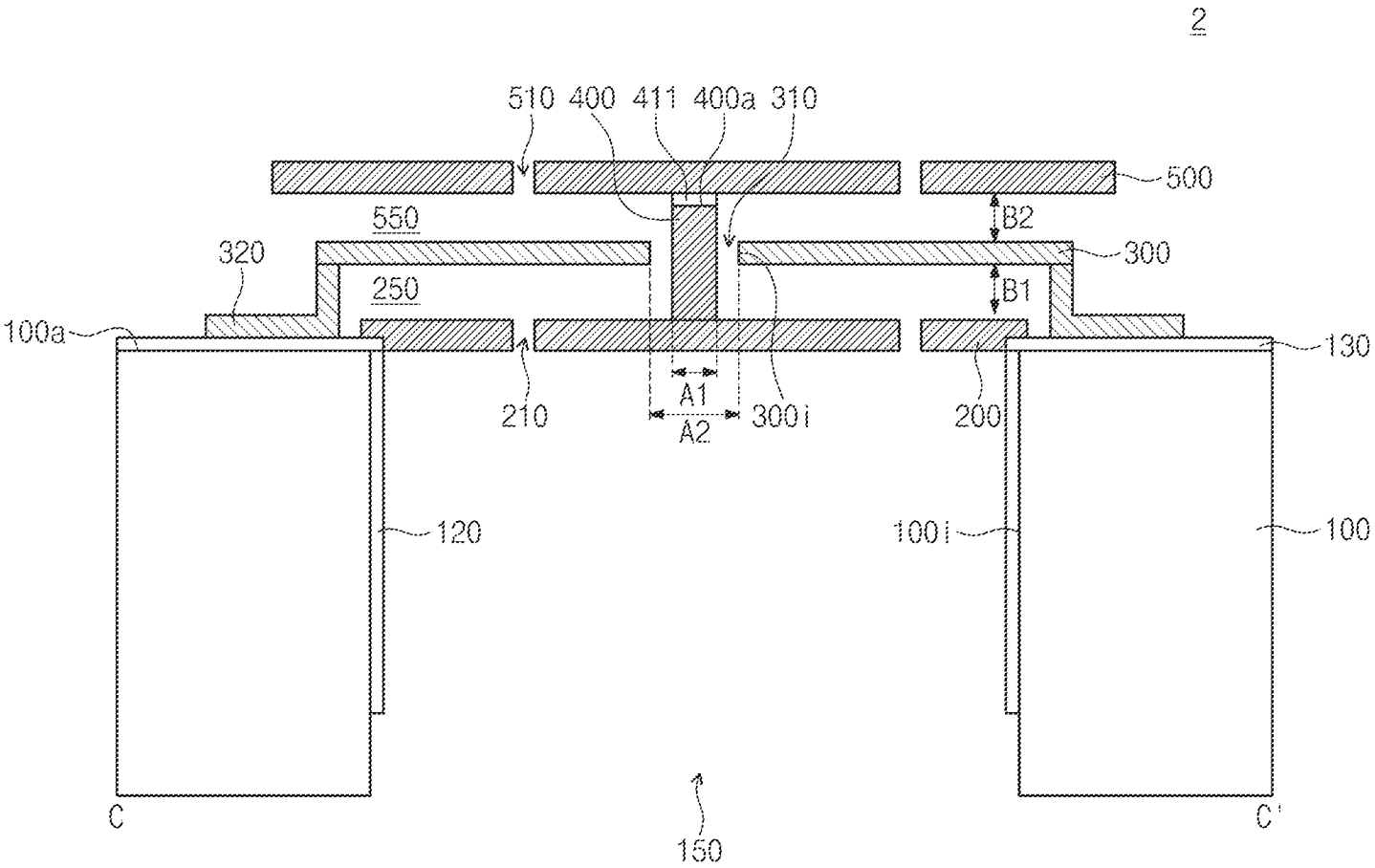

FIGS. 2A and 2B are cross-sectional views of a microphone according to another embodiment of the present invention, taken along line B-B' and C-C' of FIG. 1A, respectively. Hereinafter, the duplicated descriptions, which have been described already in the forgoing embodiment, will be omitted.

Referring to FIGS. 2A and 2B and 1A, a microphone 2 may include a substrate 100, a lower backplate 200, a diaphragm 300, a connection unit 400, and an upper backplate 500. The substrate 100, the lower backplate 200, the diaphragm 300, the connection unit 400, and the upper backplate 500 may be equal or similar to those of FIGS. 1A to 1C.

The connection unit 400 may be disposed on the lower backplate 200 to extend into a diaphragm hole 310. The connection unit 400 may be spaced apart from an inner surface 300*i* of the diaphragm 300. The connection unit 400 may include a conductive material, for example, a metal or poly silicon. An insulation layer 411 may be disposed between the connection unit 400 and the upper backplate 500. The upper backplate 500 may not be electrically connected to the lower backplate 200 by the insulation layer 411.

Figure 3A:
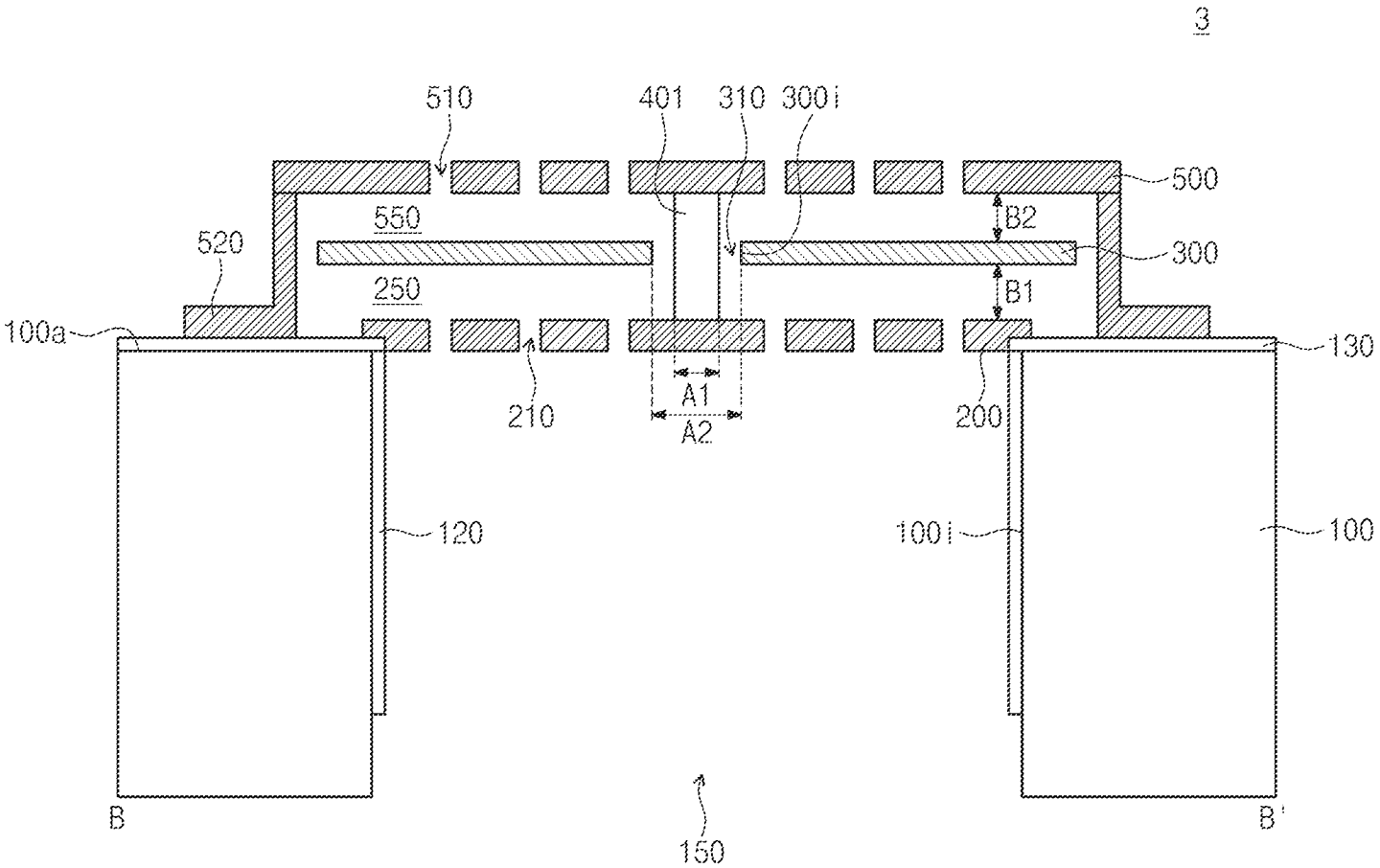
FIGS. 3A and 3B are cross-sectional views of a microphone according to further another embodiment of the present invention.
Figure 3B:
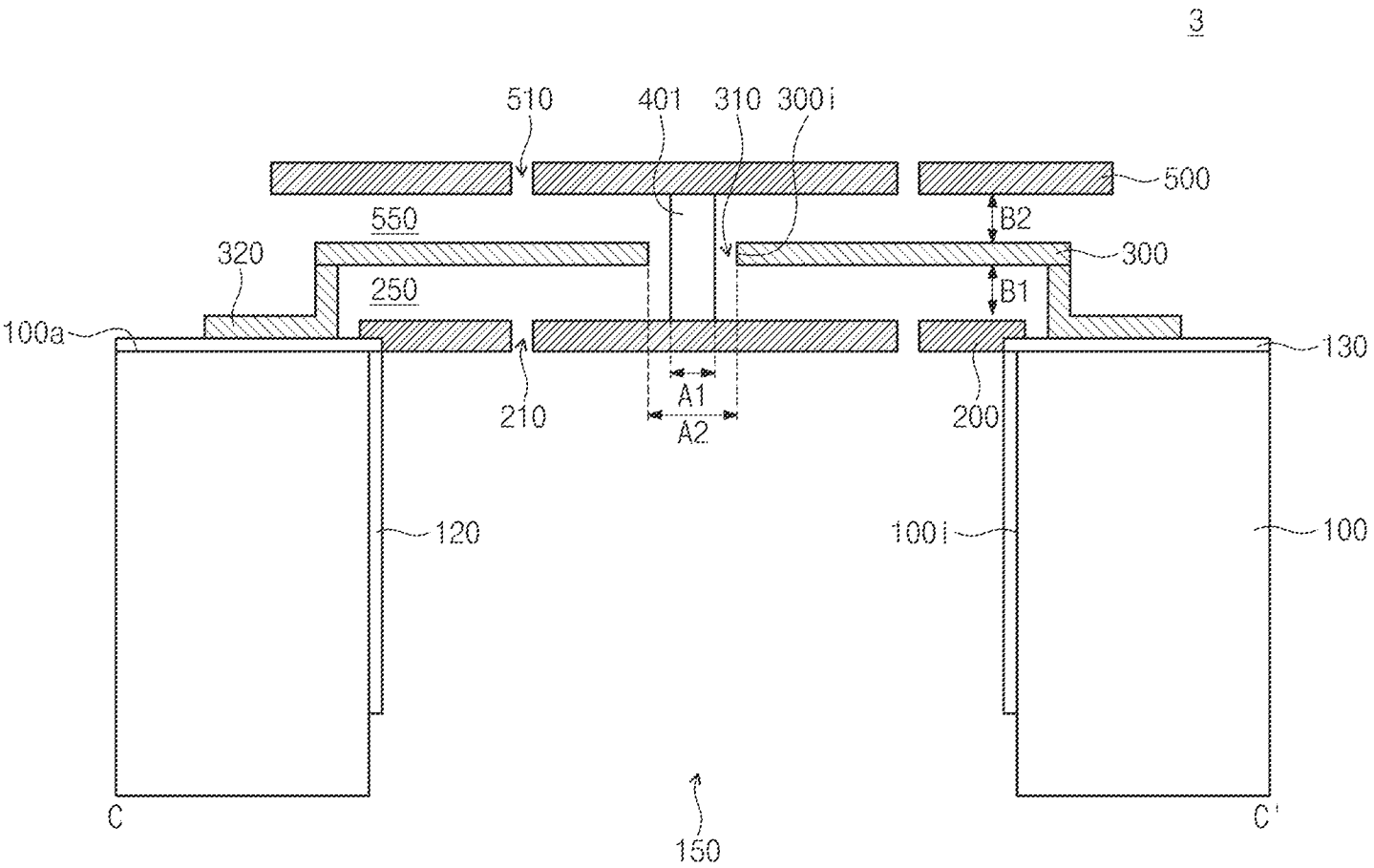

FIGS. 3A and 3B are cross-sectional views of a microphone according to further another embodiment of the present invention, taken along line B-B' and C-C' of FIG. 1A, respectively. Hereinafter, the duplicated descriptions, which have been described already in the forgoing embodiment, will be omitted.

Referring to FIGS. 3A and 3B and 1A, a microphone 3 may include a substrate 100, a lower backplate 200, a diaphragm 300, a connection unit 401, and an upper backplate 500. The substrate 100, the lower backplate 200, the diaphragm 300, the connection unit 400, and the upper backplate 500 may be equal or similar to those of FIGS. 1A to 1C.

The connection unit 401 may be disposed on the lower backplate 200 to extend into a diaphragm hole 310. The connection unit 401 may include an insulating material. The upper backplate 500 may not be electrically connected to the lower backplate 200. Thus, an insulation layer (not shown) may not be provided between the lower backplate 200 and the connection unit 401 or between the connection unit 401 and the upper backplate 500. The upper backplate 500 may be disposed on the connection unit 401. The upper backplate 500 may be stably fixed to the substrate 100 and the lower backplate 200 by the connection unit 401.

Figure 4A:
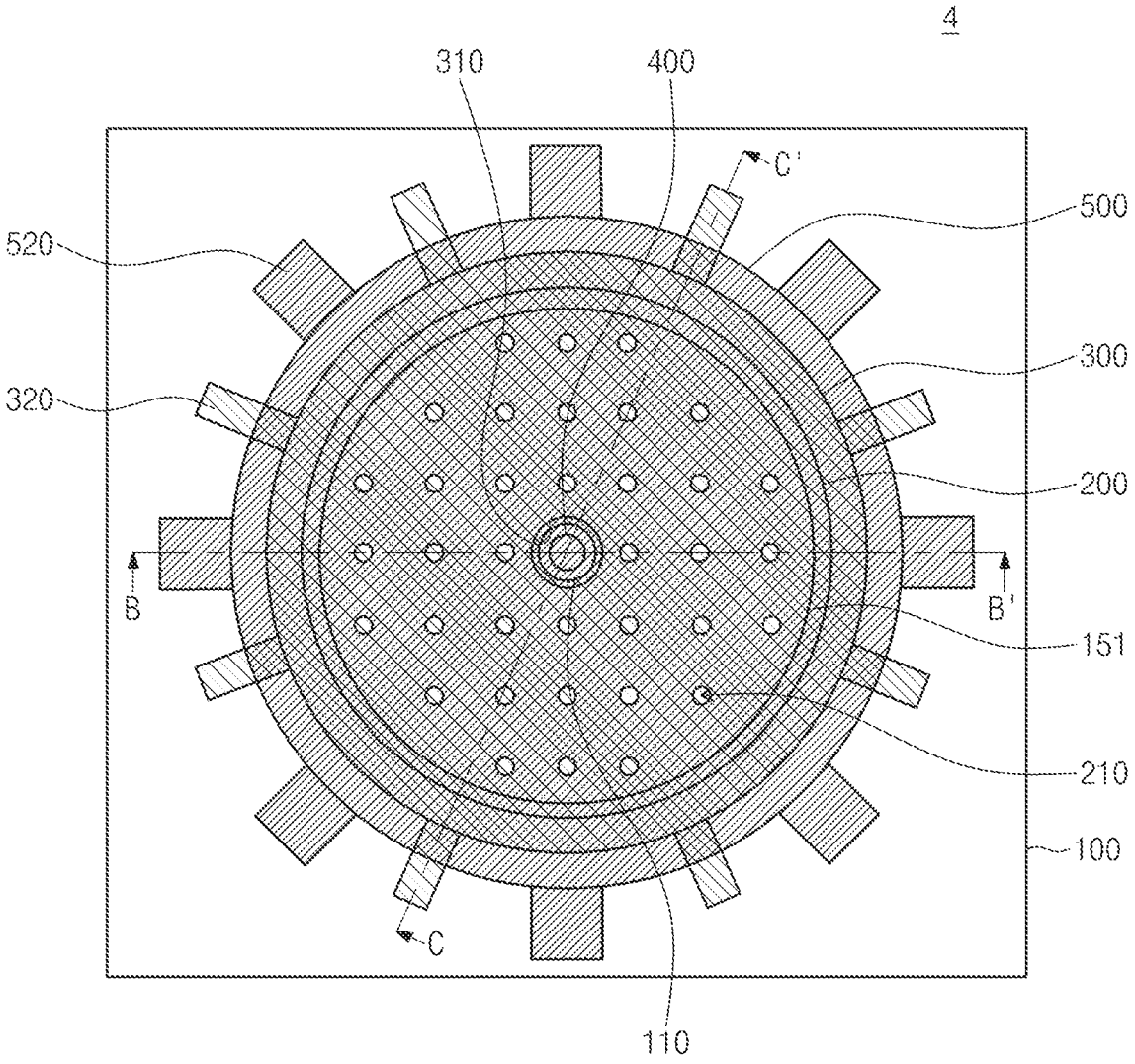
FIG. 4A is a plan view of a microphone according to further another embodiment of the present invention.
Figure 4B:
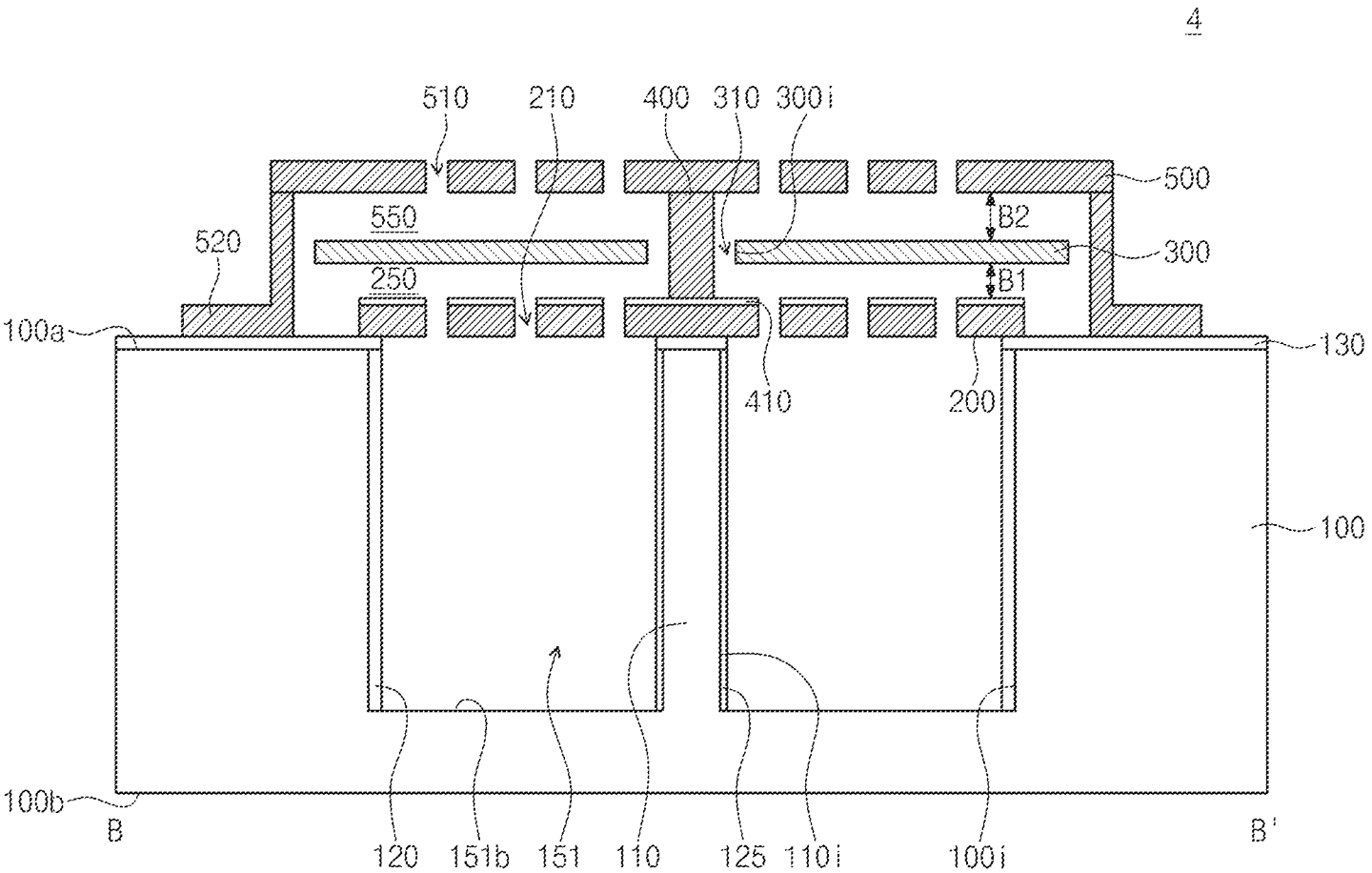
FIG. 4B is a cross-sectional view taken along line B-B' of FIG. 4A.
Figure 4C:
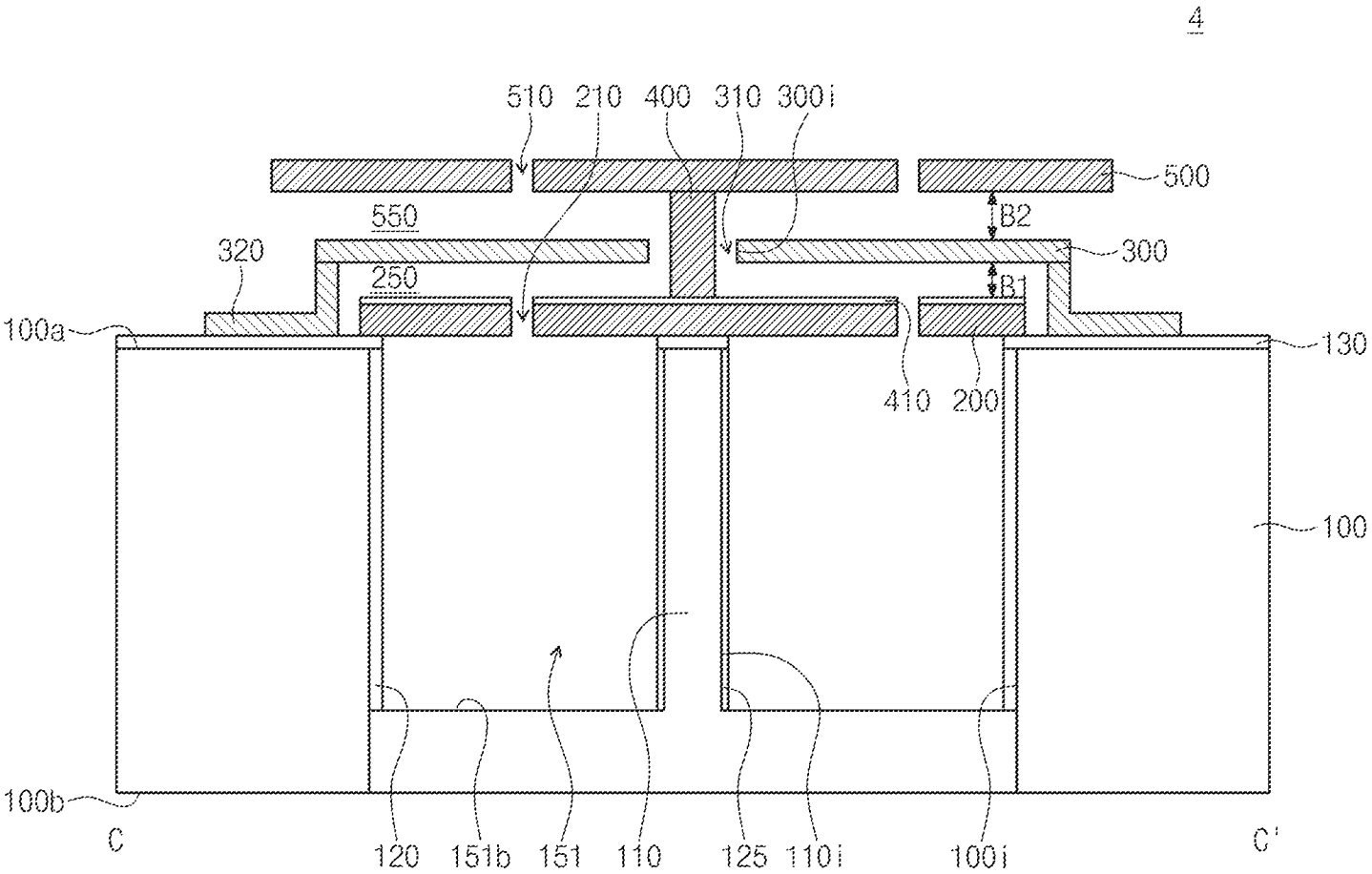
FIG. 4C is a cross-sectional view taken along line C-C' of FIG. 4A.

FIGS. 4A to 4C are plan and cross-sectional views of a microphone according to further another embodiment of the present invention. FIG. 4B is a cross-sectional view taken along line B-B' of FIG. 4A. FIG. 4C is a cross-sectional view taken along line C-C' of FIG. 4A. Hereinafter, the duplicated descriptions, which have been described already in the forgoing embodiment, will be omitted.

Referring to FIGS. 4A to 4C, a microphone 4 may include a substrate insulation layer 130, a lower backplate 200, a diaphragm 300, a connection unit 400, and upper backplate 500, which are disposed above a top surface 100*a* of a substrate 100. The substrate insulation layer 130, the lower backplate 200, the diaphragm 300, the connection unit 400, and the upper backplate 500 may be equal or similar to those of FIGS. 1A to 1C.

An acoustic chamber 151 may have a shape that is recessed from a top surface 100*a* of the substrate 100 toward a bottom surface 100*b* of the substrate 100. The acoustic chamber 151 may not pass through the bottom surface 100*b* of the substrate 100, unlike the acoustic chamber 151 of FIGS. 1A to 1C. A bottom surface 151*b* of the acoustic chamber 151 may have a level greater than that of the bottom surface 100*b* of the substrate 100. A protection layer 120 may cover an inner surface 100*i* of the substrate 100 having the acoustic chamber 120. The protection layer 120 may be equal or similar to that 120 of FIGS. 1A to 1C.

A lower backplate support 110 may be provided in the acoustic chamber 151. In view of plane, the lower backplate support 110 may be disposed at a position that corresponds to a core of the acoustic chamber 151. The lower backplate support 110 may extend to the top surface 100*a* of the substrate 100 on the bottom surface 151*b* of the acoustic chamber 151. The lower backplate support 110 may be integrated with the substrate 100. For example, the lower backplate support 110 may be connected to the substrate 100. The lower backplate support 110 may include the same material as the substrate 100. The lower backplate support 110 may be disposed between the bottom surface 151*b* of the acoustic chamber 151 and a bottom surface of the lower backplate 200. The lower backplate 200 may be more stably fixed to the substrate 100 by the lower backplate support 110. Thus, a distance B2 between the diaphragm 300 and the upper backplate 500 may be equal to that B1 between the diaphragm 300 and the lower backplate 200. Since the lower backplate 200 has a thinner thickness, an external acoustic pressure may smoothly pass between a lower hole 210 and a lower gap 250. The microphone 4 according to the current embodiment may be improved in sensitivity and reliability. A support protection layer 125 may cover a side surface 100*i* of the lower backplate support 110. The support protection layer 125 may include a material having etch selectivity with respect to the substrate 100. The substrate insulation layer 130 may be disposed between the substrate 100 and the lower backplate 200 and between the lower backplate support 110 and the lower backplate 200.

Figure 5A:
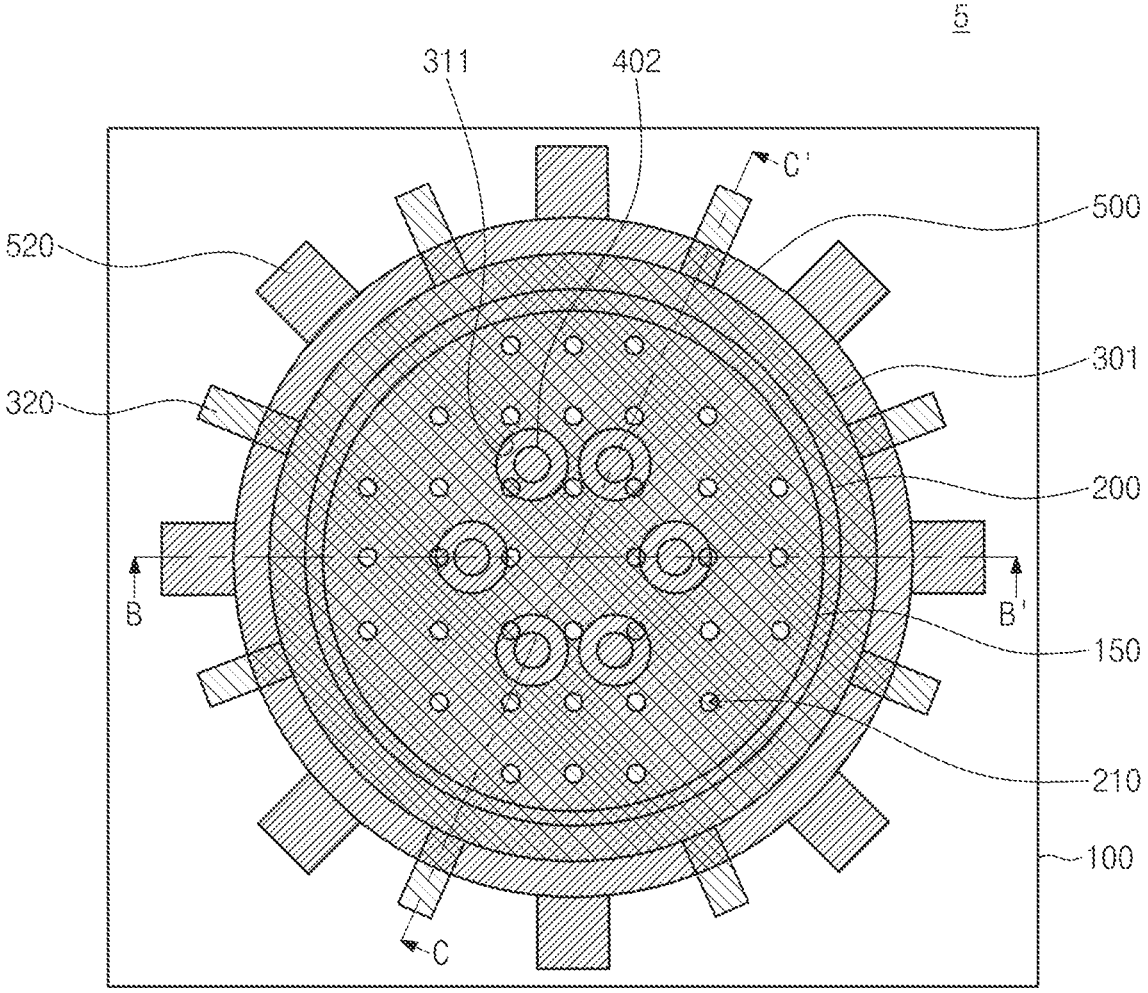
FIG. 5A is a plan view of a microphone according to further another embodiment of the present invention.
Figure 5B:
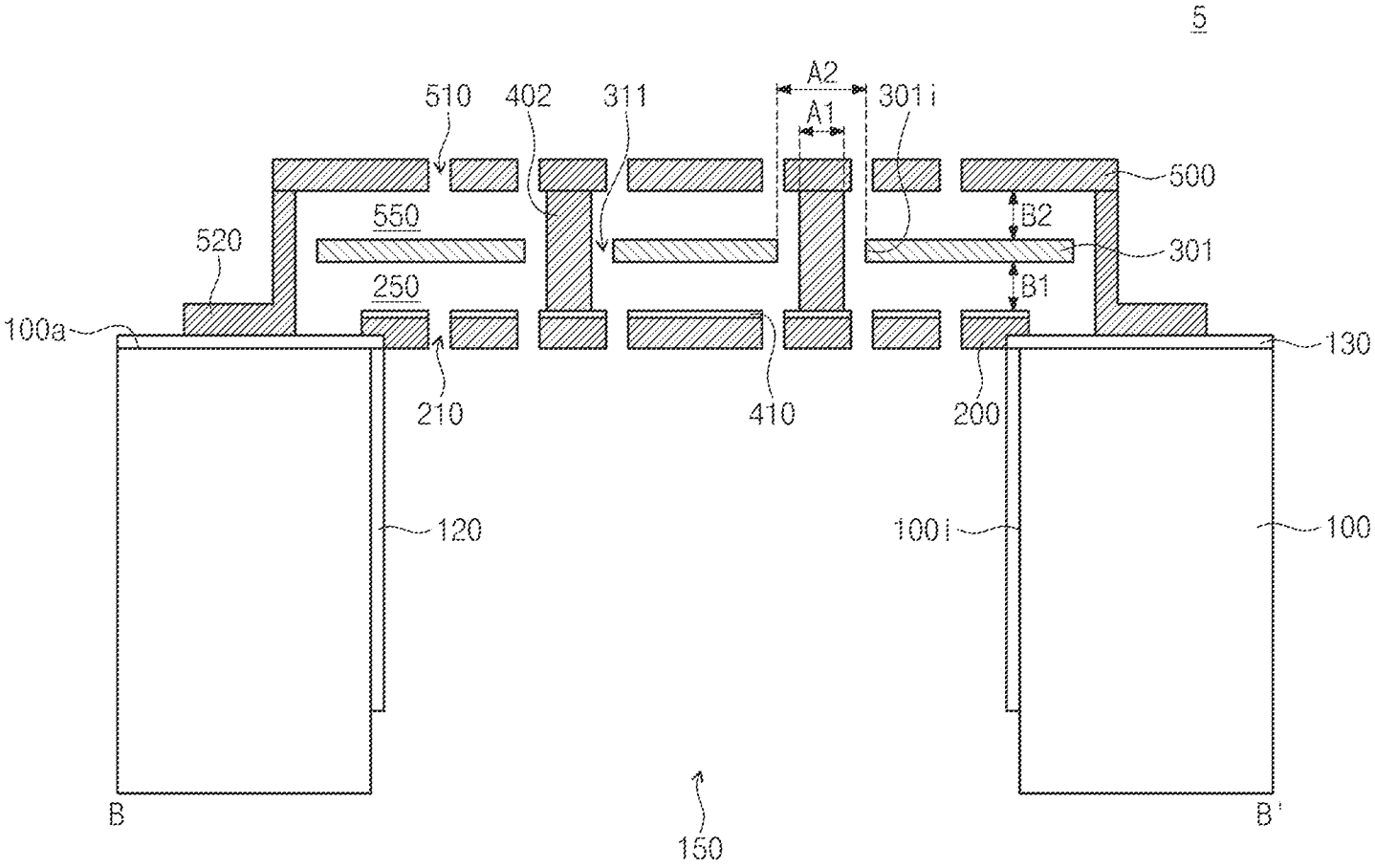
FIG. 5B is a cross-sectional view taken along line B-B' of FIG. 5A.
Figure 5C:
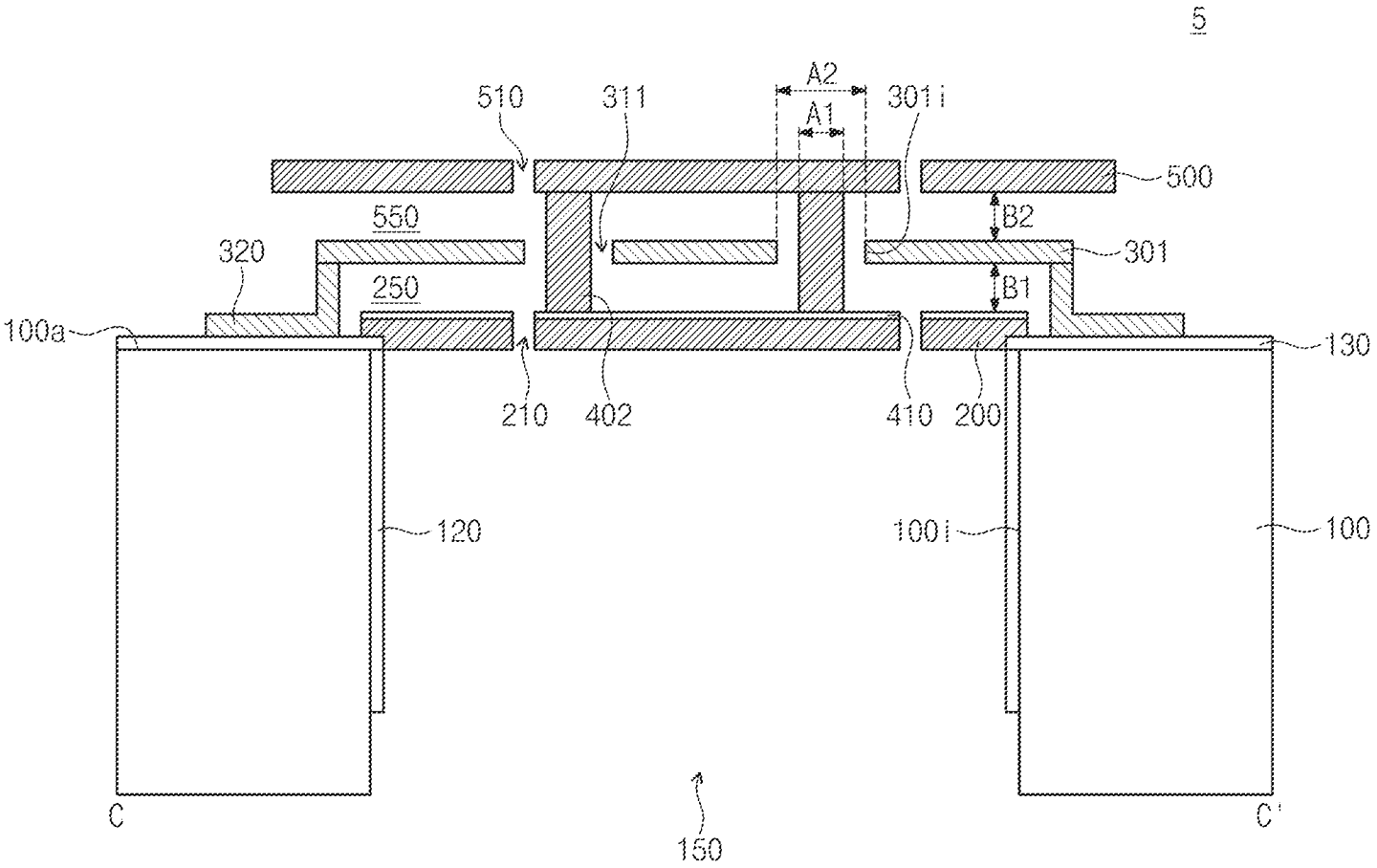
FIG. 5C is a cross-sectional view taken along line C-C' of FIG. 5A.

FIGS. 5A to 5C are plan and cross-sectional view of a microphone according to further another embodiment of the present invention. FIG. 5B is a cross-sectional view taken along line B-B' of FIG. 5A. FIG. 5C is a cross-sectional view taken along line C-C' of FIG. 5A.

Referring to FIGS. 5A to 5C, a microphone 5 may include a substrate insulation layer 130, a lower backplate 200, a diaphragm 301, connection units 402, and an upper backplate 500, which are disposed above a top surface 100*a* of a substrate 100. The substrate insulation layer 130, the lower backplate 200, and the upper backplate 500 may be equal or similar to those of FIGS. 1A to 1C. For example, an acoustic chamber 150 may pass through the substrate 100. Alternatively, the acoustic chamber 150 may be recessed from the top surface 100*a* of the substrate 100, like the acoustic chamber 150 of FIGS. 4A to 4C. In this case, a lower backplate support (reference numeral 110 of FIGS. 4B and 4C) may be further provided within an acoustic chamber 150 to fix the lower backplate 200 to the substrate 200.

The diaphragm 301 may be disposed on the lower backplate 200. A plurality of diaphragm holes 311 may pass through the diaphragm 301. The diaphragm support part 320 may fix the diaphragm 301 to the substrate 100.

The connection units 402 may be disposed between the lower backplate 200 and the upper backplate 500. The connection units 402 may extend into the diaphragm holes 311, respectively. Each of the connection units 402 may have a width A1 less than a diameter A2 of each of the diaphragm holes 311. Thus, each of the connection units 402 may be spaced apart from an inner surface 301*i* of each of the diaphragm 301. A lower gap 250 may be connected to an upper gap 550 through each of the diaphragm holes 311. For example, each of the connection units 402 may include a conductive material. An insulation layer 410 may be disposed between the lower backplate 200 and each of the connection units 402. For another example, as described in FIGS. 2A and 2B, each of the connection units 402 may include a conductive material, and the insulation layer 410 may be disposed between the connection unit 402 and the upper backplate 500. For another example, each of the connection units 402 may include an insulating material. In this case, the insulation layer 410 may be omitted.

The upper backplate 500 may be disposed on a top surface of each of the connection units 402. The upper backplate 500 may be spaced apart from the diaphragm 301 on the diaphragm 301. The upper backplate 500 may have an upper hole passing therethrough. The upper backplate support part 520 may extend from the upper backplate 500 toward the substrate 100.

Since the connection units 402 are provided in plurality, the upper backplate 500 may be more stably fixed to the lower backplate 200. Also, the distance B2 between the diaphragm 301 and the upper backplate 500 may be more equal to that B1 between the lower backplate 200 and the diaphragm 300. The upper backplate 500 may have a thinner thickness. The external acoustic pressure may smoothly pass between the upper hole 510 and the upper gap 550. Thus, the microphone 5 may be more improved in sensitivity and reliability.

FIGS. 6A to 9A are plan views illustrating a process of manufacturing a microphone according to an embodiment of the present invention. FIGS. 6A to 9B are cross-sectional view taken along line B-B' of FIGS. 6A to 9A, respectively. FIGS. 6C to 9C are cross-sectional view taken along line C-C' of FIGS. 6A to 9A, respectively. Hereinafter, the duplicated descriptions, which have been described already in the forgoing embodiment, will be omitted.

Figure 6A:
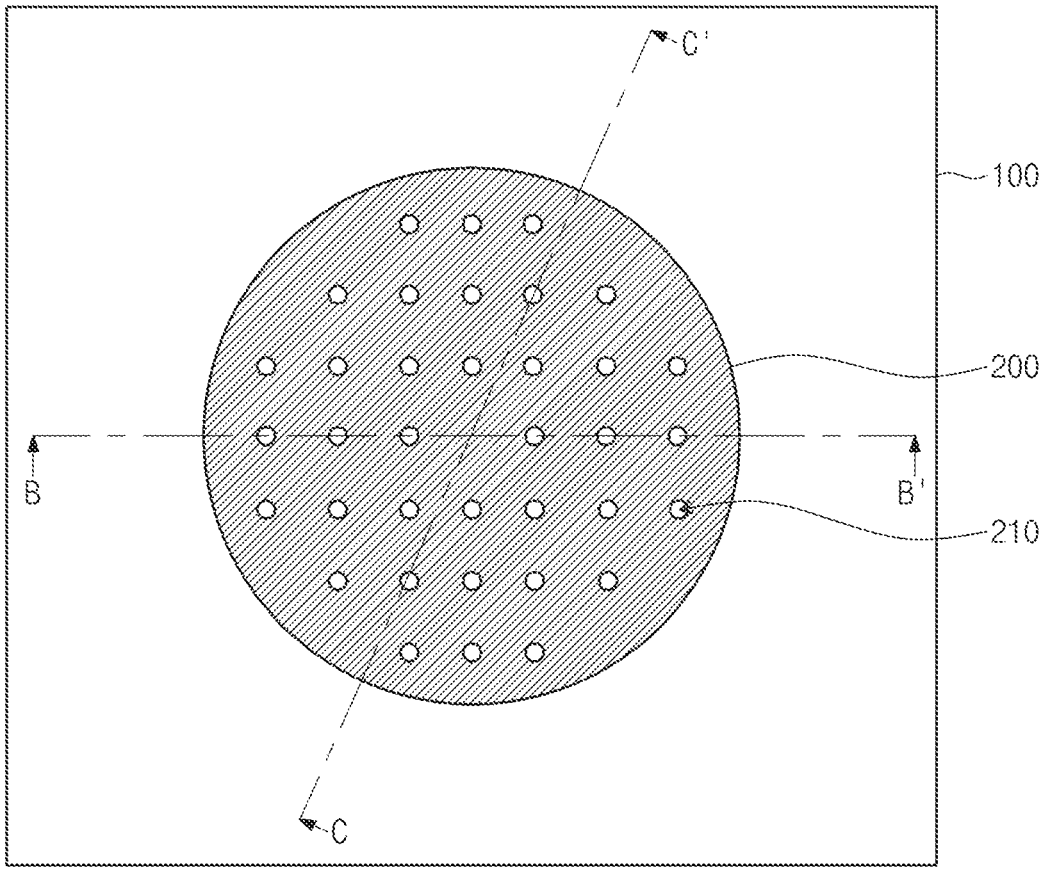
Figure 6B:
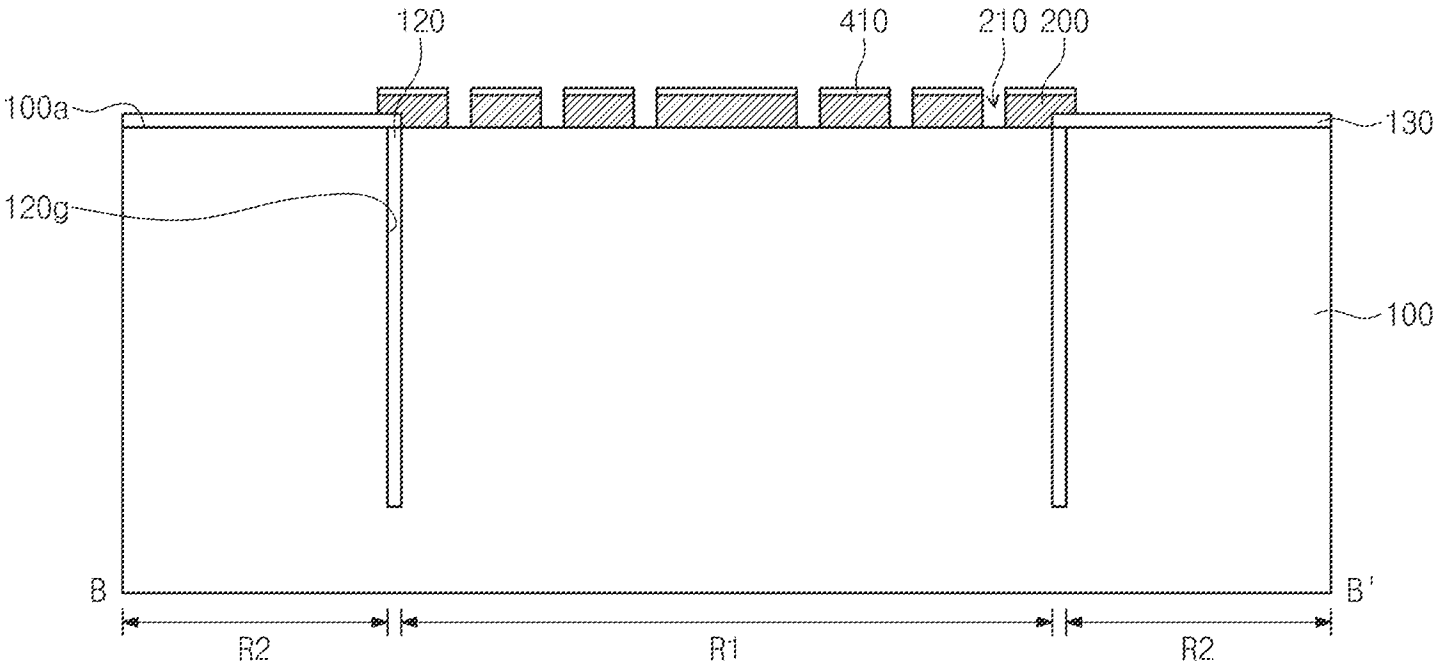
Figure 6C:
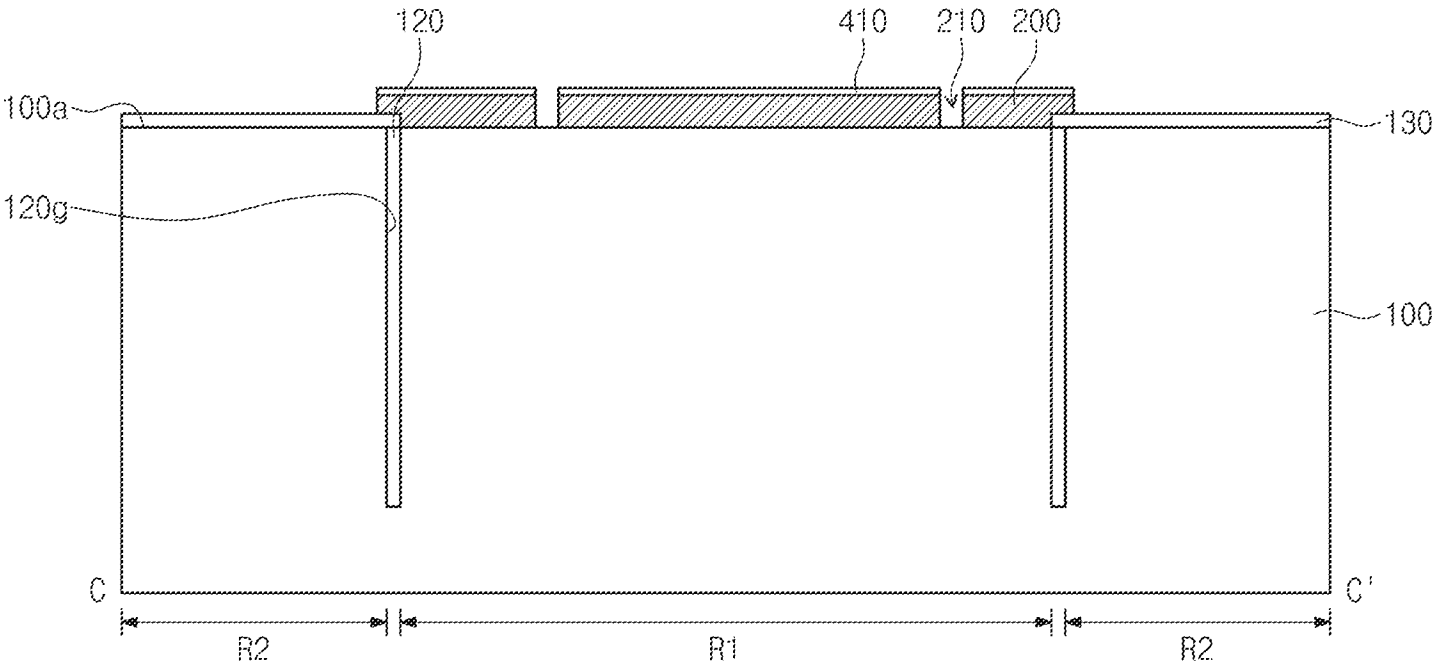

Referring to FIGS. 6A to 6C, a protection layer 120, a substrate insulation layer 130, and a lower backplate 200 may be disposed on a substrate 100. For example, the substrate 100 may be etched to form a groove 120*g* in the substrate 100. A material having etch selectivity different from that of the substrate 100 may be filled into the groove 120*g*. A chamber R1 and a support region R2 may be defined by the protection layer 120. The chamber region R1 may be a region that corresponds to the inside of the protection layer 120 in the substrate 120. The support region R2 may be a region that corresponds to the outside of the protection layer 120. The substrate insulation layer 130 may be applied to a top surface 100*g* of the substrate 100. The lower backplate 200 may be disposed on the substrate 100. The lower backplate 200 may cover a portion of the substrate insulation layer 130. For example, a conductive material may be deposited on the substrate insulation layer 130, and then, the deposited conductive layer may be patterned to form the backplate 200. The conductive adhesive material may include a metal or poly silicon. For another example, the lower backplate 200 may include an insulating core and a conductive layer that is applied to surround the core. Here, a lower hole 210 may pass through the lower backplate 200. The lower hole 210 may expose a top surface 100*a* of the substrate 100. An insulation layer 410 may be disposed on the lower backplate 200. The lower backplate 200 and the insulation layer 410 may be equal or similar to those of FIGS. 1A to 1C.

Figure 7A:
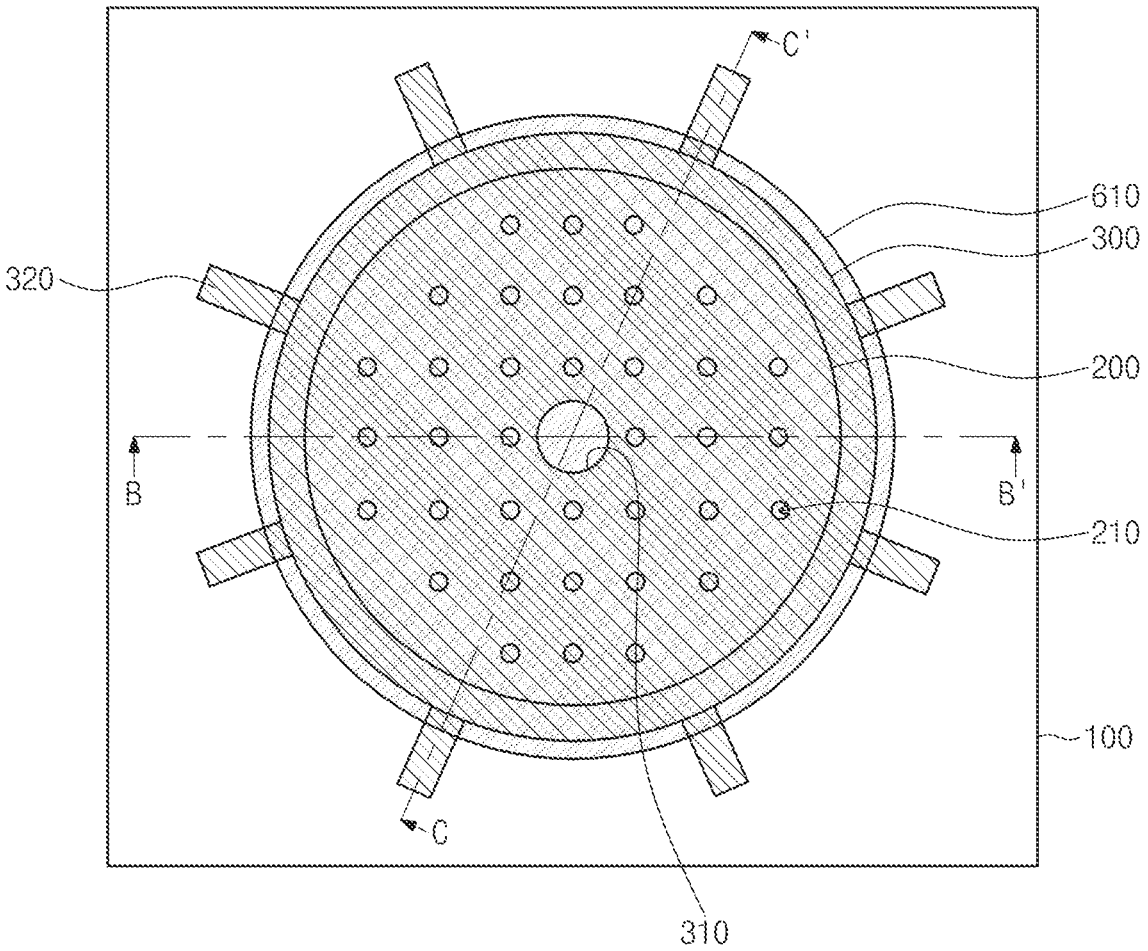
Figure 7B:
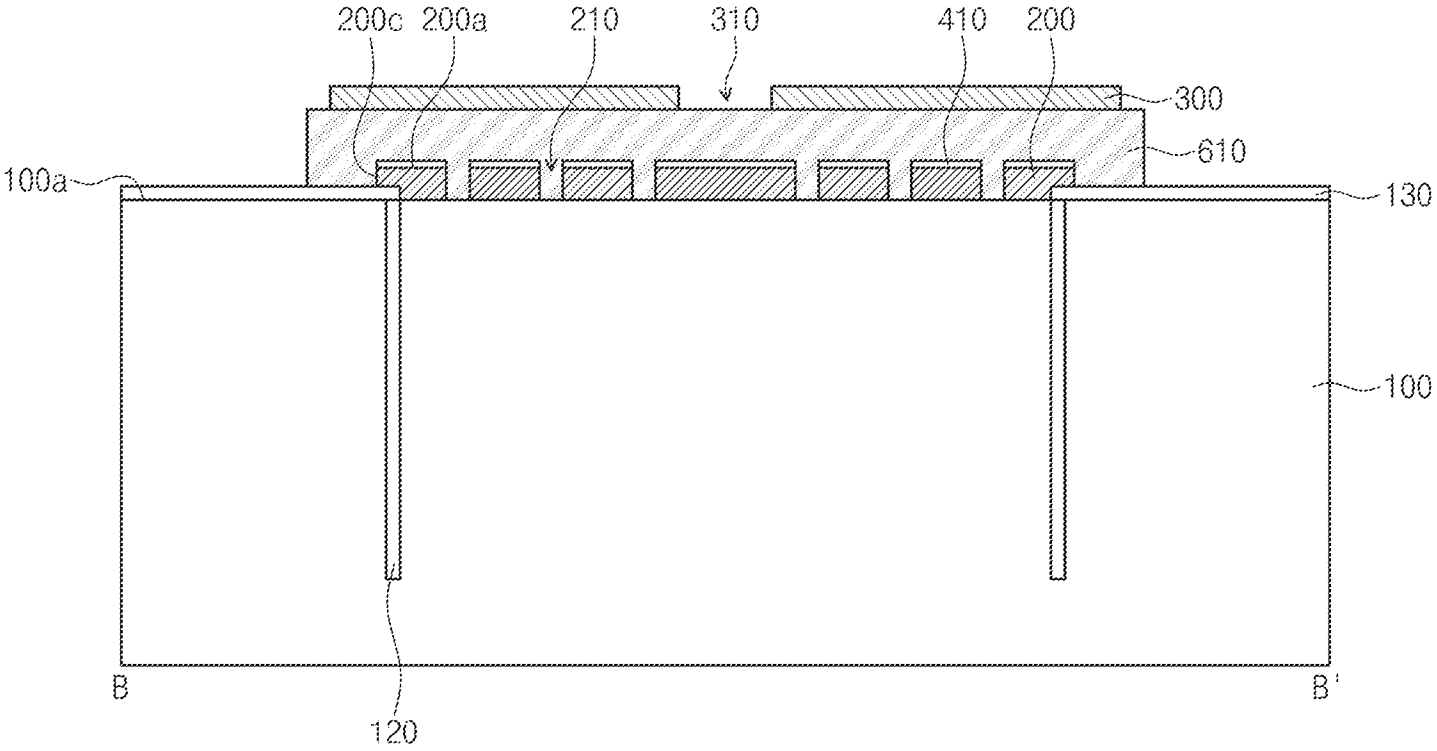
Figure 7C:
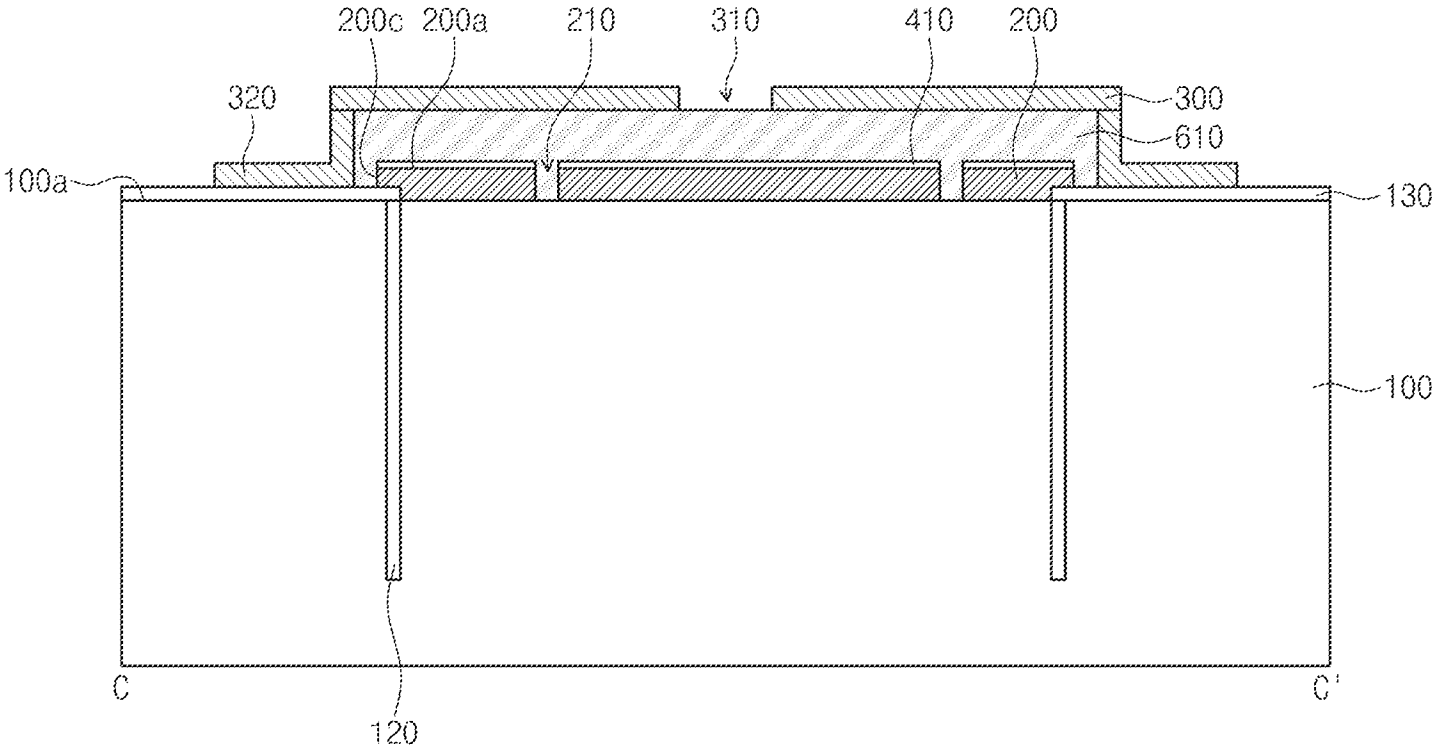

Referring to FIGS. 7A to 7C, a first sacrificial layer 610 and a diaphragm 300 may be successively disposed on the lower backplate 200. The first sacrificial layer 610 may be disposed on top and side surfaces 200*a* and 200*c* of the lower backplate 200 to fill the lower hole 210. An oxide or organic material may be deposited, and the deposited oxide or organic material layer may be patterned to form the first sacrificial layer 610. The first sacrificial layer 610 may be disposed on the diaphragm 300. The diaphragm 300 may be spaced apart from the lower backplate 200 by the first sacrificial layer 610. Here, a diaphragm hole 310 may pass through the diaphragm 300. The diaphragm hole 310 may be defined in a position that corresponds to a core of the diaphragm 300. The diaphragm hole 310 may expose the first sacrificial layer 610. As shown in FIG. 7C, a diaphragm support part 320 may be disposed between the substrate 100 and the diaphragm 300. The diaphragm support part 320 may be disposed on a sidewall of the first sacrificial layer 610.

Figure 8A:
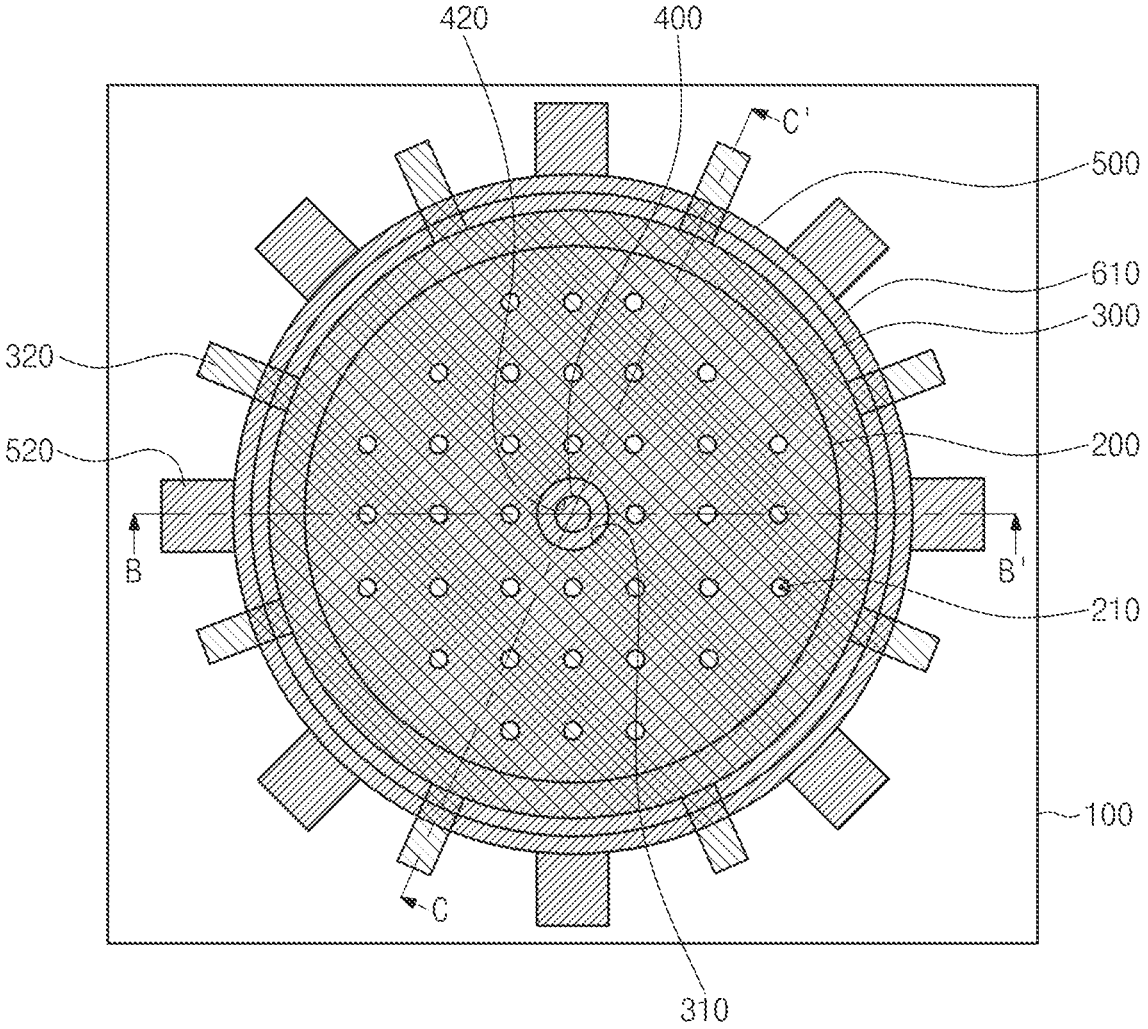
Figure 8B:
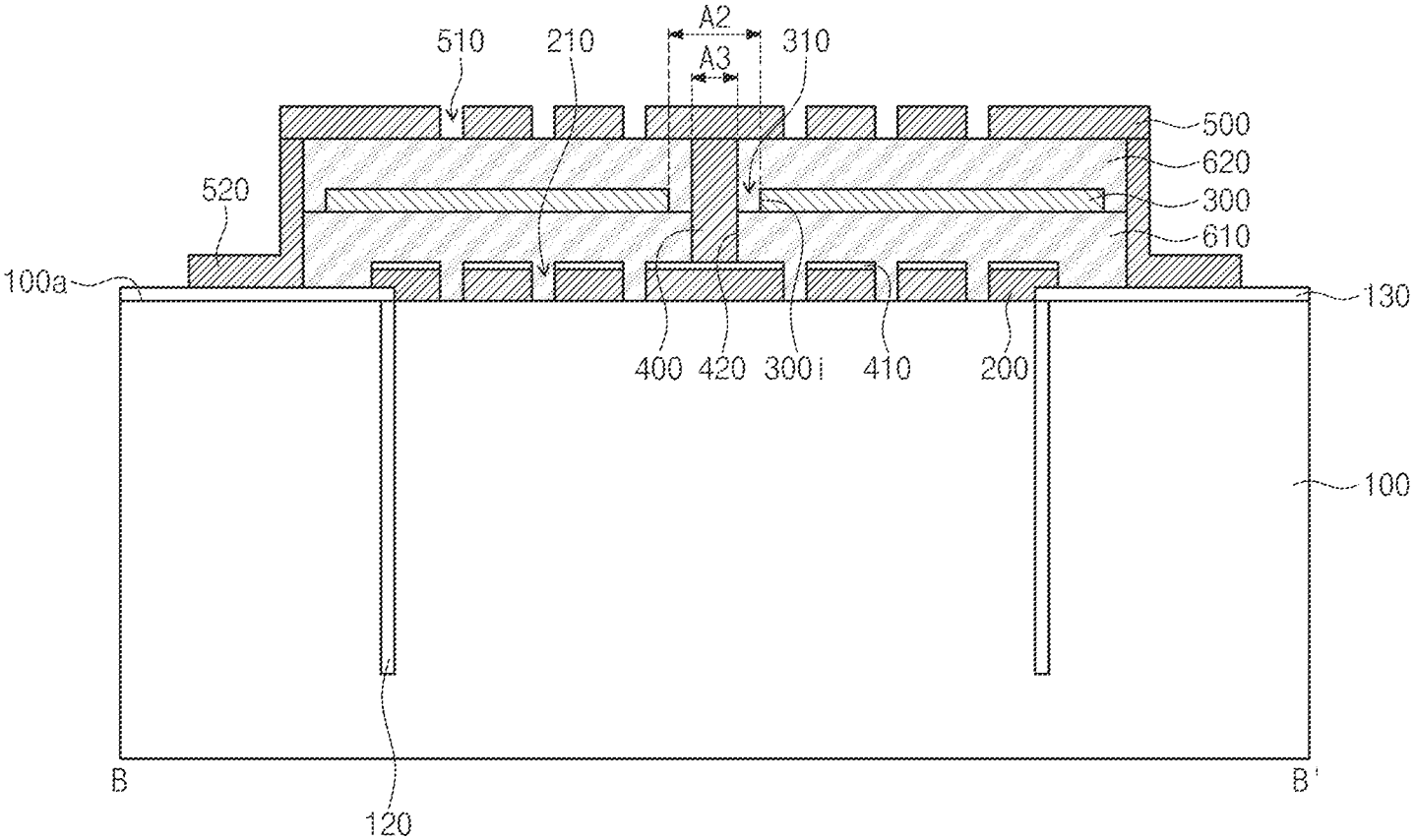
Figure 8C:
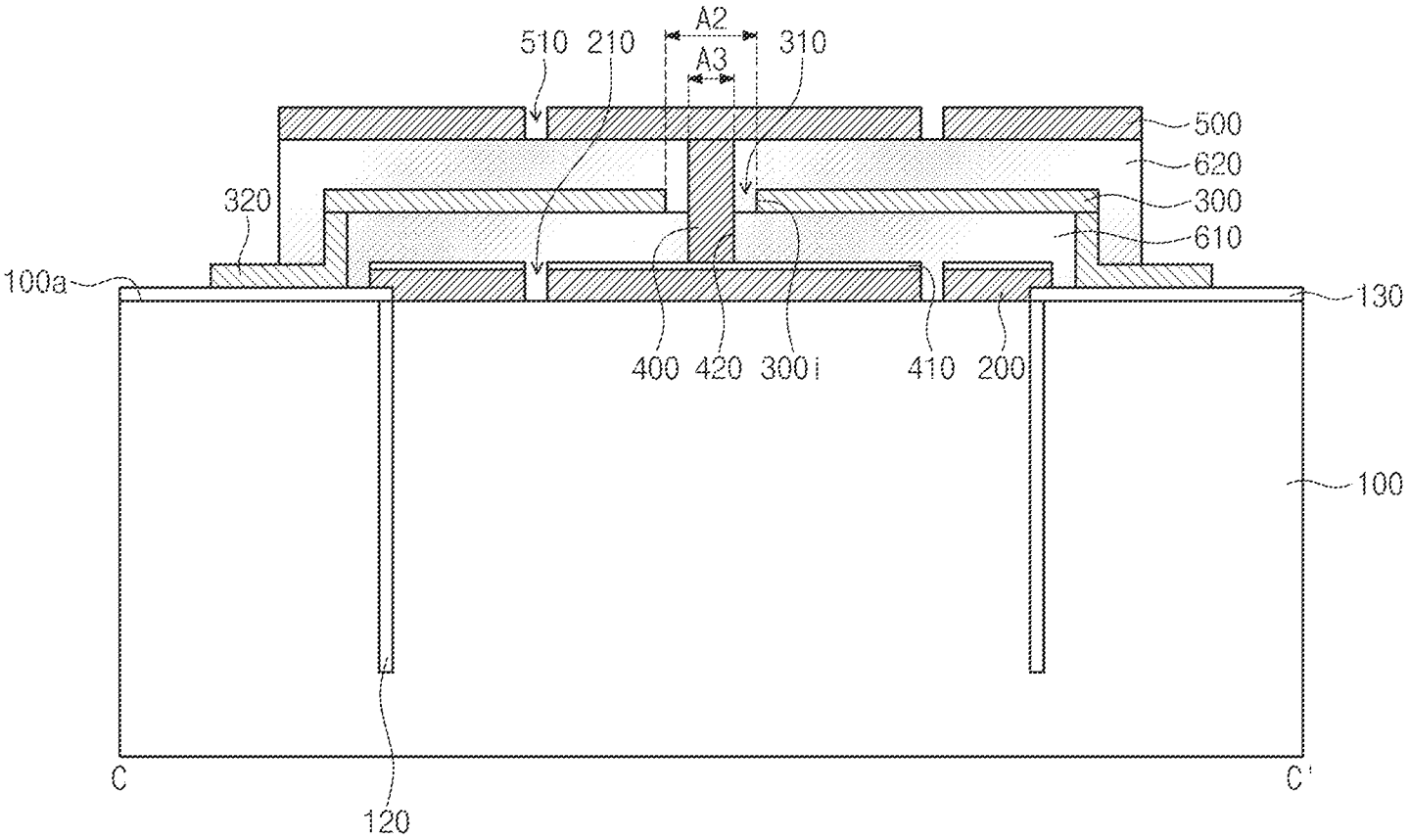

Referring to FIGS. 8A to 8C, a second sacrificial layer 620, a connection unit 400, and an upper backplate 500 may be provided. The second sacrificial layer 620 may be disposed on top and side surfaces 300*a* and 300*c* of the diaphragm 300 to fill the diaphragm hole 310. As shown in FIG. 8A, the second sacrificial layer 620 may overlap the first sacrificial layer 610. The second sacrificial layer 620 may include the same material as the first sacrificial layer 610, for example, an oxide or organic material. A hole 420 may pass through the first and second sacrificial layers 610 and 620. The hole 420 may expose a top surface of the insulation layer 410. The hole 420 may be defined at a position that corresponds to a core of the first and second sacrificial layers 610 and 620. In view of plane, the hole 420 may overlap the diaphragm hole 310. The hole 420 may have a width A3 less than that A2 of the diaphragm hole 310. Thus, the hole 420 may not expose an inner sidewall 300*i* of the diaphragm 300. The connection unit 400 may be disposed within the hole 420. The connection unit 400 may not contact the inner sidewall 300*i* of the diaphragm 300. The connection unit 400 may include a conductive material. For another example, the connection unit 400 may include an insulating material. In this case, the lower hole 210 and the diaphragm hole 310 may expose the lower backplate 200, and the insulation layer 410 may be omitted.

A conductive material may be deposited, and then the deposited conductive material layer may be etched to form an upper backplate 500. For another example, the upper backplate 500 may include an insulation core part and a conductive material layer that is applied to both surfaces of the insulating core part. An upper hole 510 may pass through the upper backplate 500. The upper hole 510 may expose the second sacrificial layer 620. For example, the upper backplate 500 may be formed by the same process as that of the connection unit 400. The upper backplate 500 may include the same material as the connection unit 400. For another example, the upper backplate 500 may be formed by a process different from that of the connection unit 400.

Figure 9A:
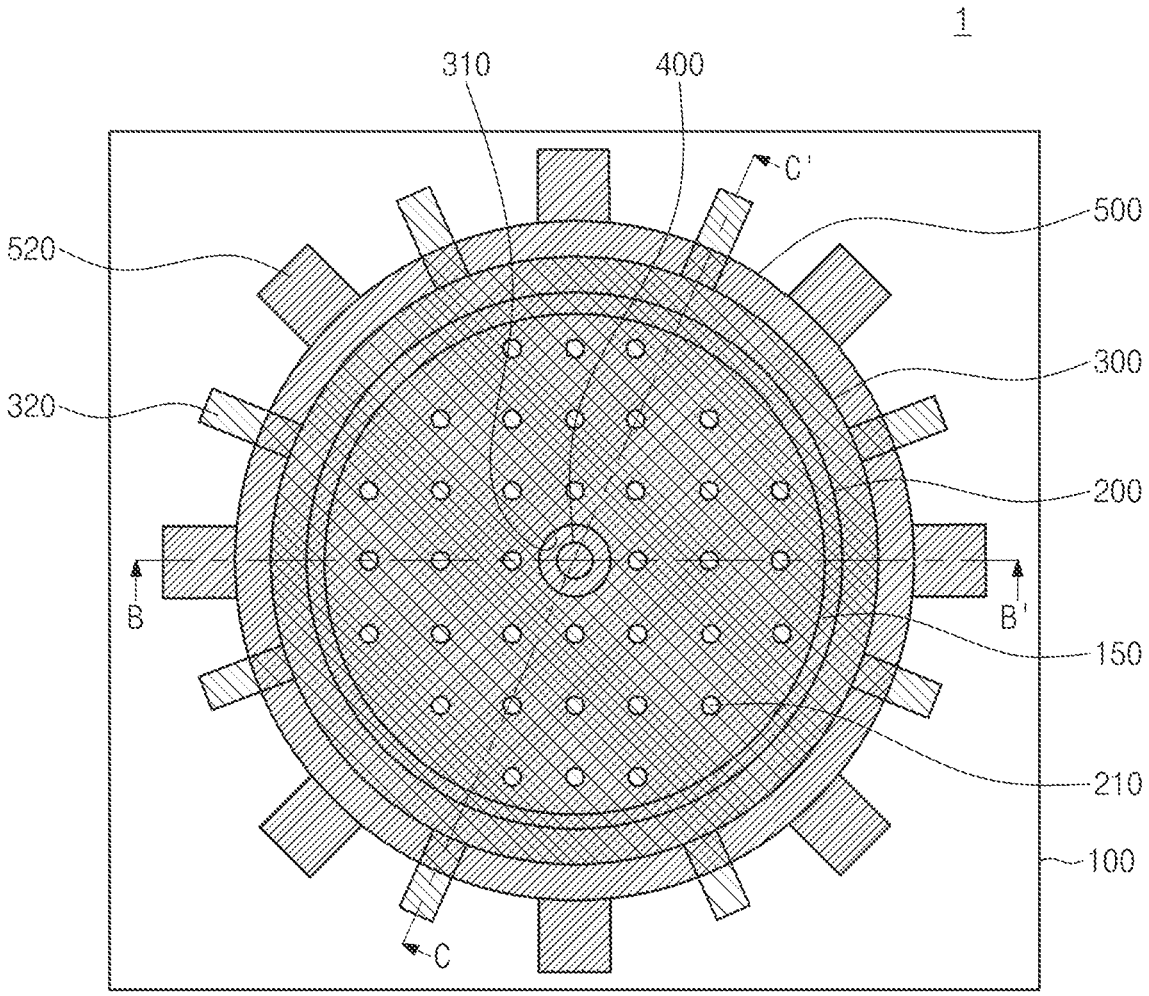
Figure 9B:
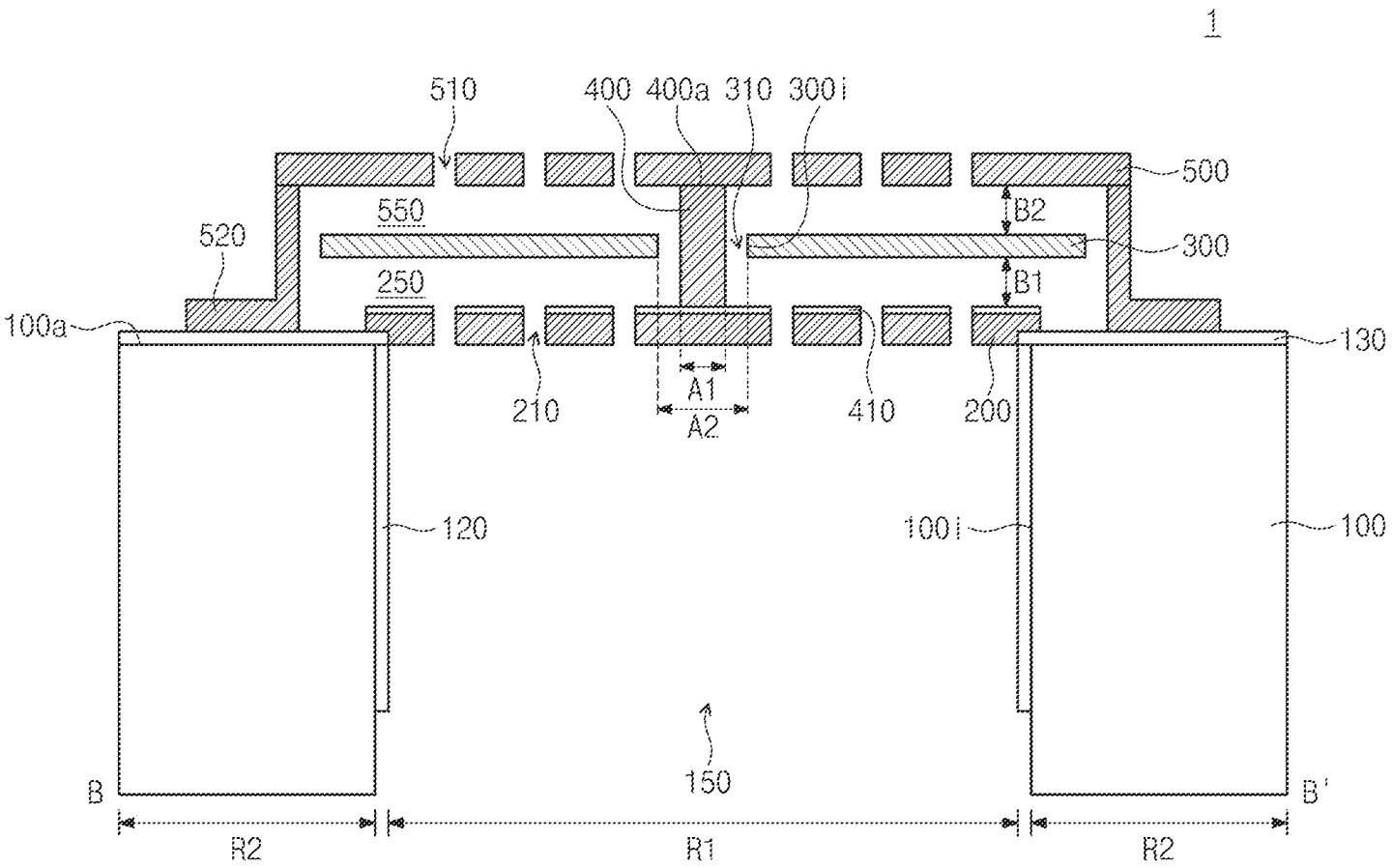
Figure 9C:
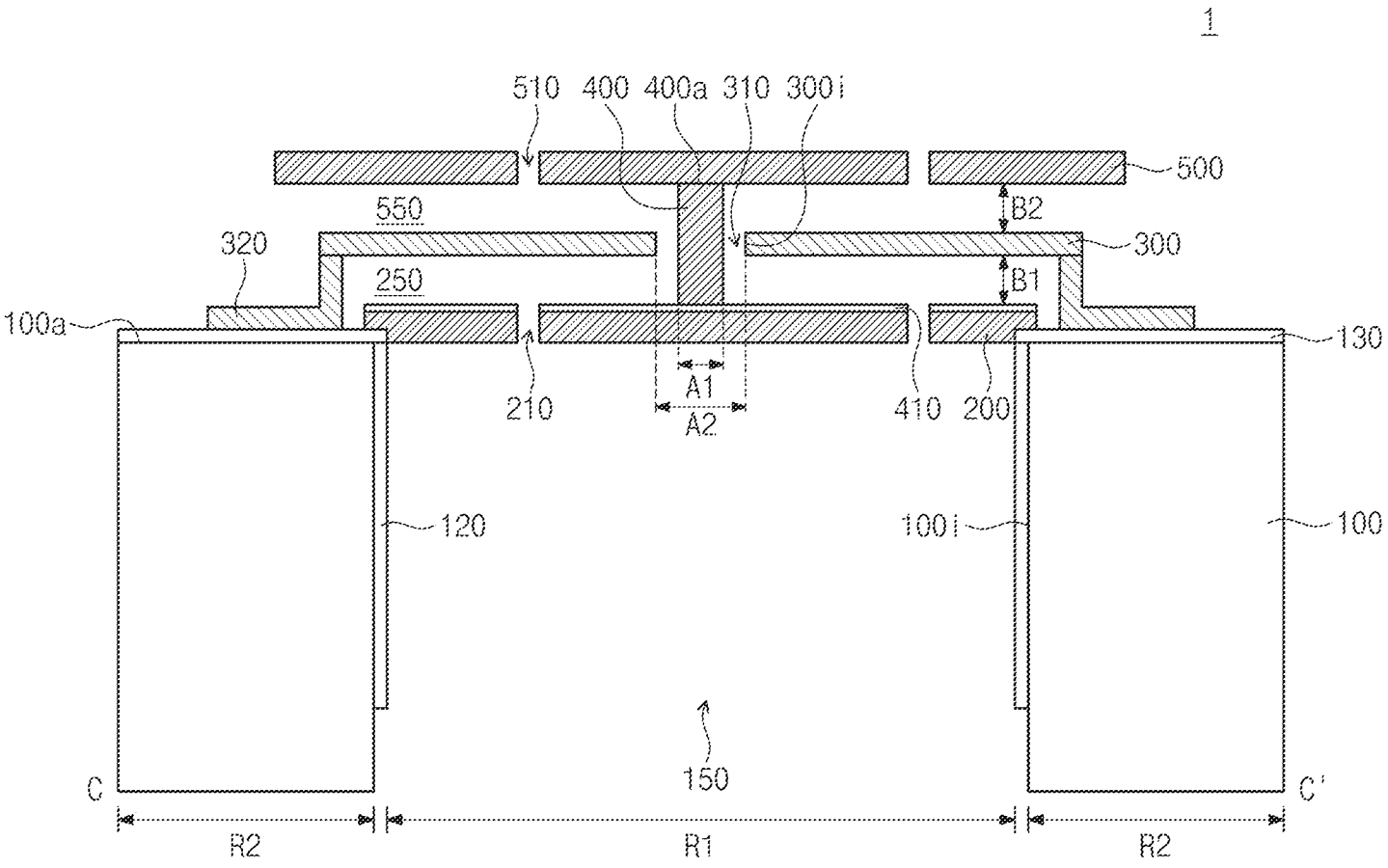

Referring to FIGS. 9A to 9C, a lower gap 250, an upper gap 54, and an acoustic chamber 150 may be provided. The sacrificial layers (reference numerals 610 and 620 of FIGS. 8B and 8C) may be removed by an etching process. The first sacrificial layer (reference numeral 610 of FIGS. 8B and 8C) and the second sacrificial layer (reference numeral 620 of FIGS. 8B and 8C) may be removed by the same etching process. For example, an etching solution or gas may be introduced through the upper hole 510 to react with the first and second sacrificial layers 610 and 620. The sacrificial layers (reference numerals 610 and 620 of FIGS. 8B and 8C) reacting with the etching solution or gas may be removed to the outside through the upper hole 510. When the sacrificial layers (reference numerals 610 and 620 of FIGS. 8B and 8C) include the same material (e.g., a silicon material), the removing of the sacrificial layers (reference numerals 610 and 620 of FIGS. 8B and 8C) and the etching of the substrate 100 may be performed by the same process. For another example, when the sacrificial layers (reference numerals 610 and 620 of FIGS. 8B and 8C) include material different from each other (e.g., organic materials), the etching process of the sacrificial layers (reference numerals 610 and 620 of FIGS. 8B and 8C) and the etching process of the substrate 100 may be different from each other. Since the second sacrificial layer (reference numeral 620 of the FIGS. 8B and 8C) is removed, an upper gap may be defined between the diaphragm 300 and the upper backplate 500. The upper gap 550 may extend between the inner sidewall 300*i* of the diaphragm 300 and the connection unit 400 and between the diaphragm 300 and an upper backplate support 520. Since the first sacrificial layer (reference numeral 610 of the FIGS. 8B and 8C) is removed, the lower gap 250 may be defined between the lower backplate 200 and the diaphragm 300. Since the gaps 250 and 550 are defined, the upper hole 510 may be connected to the lower hole 210.

The chamber region R1 of the substrate 100 may be removed so that the acoustic chamber 150 may be disposed in the substrate 100. For example, the chamber region R1 of the substrate 100 may be removed by an etching process. The protection layer 120 may prevent the etching solution or gas from being introduced into the support region R2 of the substrate 100. Thus, the support region R2 of the substrate 100 may not be removed by the etching process. The acoustic chamber 150 may pass through the substrate 100, like the acoustic chamber 150 of FIGS. 1A to 1C. For another example, a portion of the substrate 100 corresponding to the chamber region R1, e.g., an upper end of the substrate 100 may be removed. In this case, as shown in FIGS. 4A to 4C, the acoustic chamber 151 having the recessed shape may be formed.

According to the concepts of the present invention, the lower and upper backplates that are spaced apart from each other may be provided. The diaphragm may be disposed between the lower backplate and the upper backplate. As the upper backplate is provided, the microphone may be improved in reliability and sensitivity. The connection unit may extend into the diaphragm hole on the lower backplate. The upper backplate may be stably fixed to the lower backplate by the connection unit. As the upper backplate is stably fixed, the upper backplate may be reduced in thickness. The backplates may be spaced a predetermined distance from the diaphragm. Thus, the microphone may be more improved in sensitivity and reliability.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A microphone comprising:

a substrate comprising an acoustic chamber;

a lower backplate disposed on the substrate;

a diaphragm spaced apart from the lower backplate on the lower backplate, the diaphragm having a diaphragm hole passing therethrough;

a connection unit disposed on the lower backplate to extend through the diaphragm hole; and an upper backplate disposed on the connection unit, the upper backplate being spaced apart from the diaphragm.

wherein the connection unit penetrates a center of the diaphragm.

2. The microphone of claim 1, wherein a distance between the diaphragm and the lower backplate is equal to a distance between the diaphragm and the upper backplate.

3. The microphone of claim 1, wherein the connection unit has a width less than a diameter of the diaphragm hole.

4. The microphone of claim 1, wherein the connection unit is spaced apart from an inner sidewall of the diaphragm, and a gap is defined between the connection unit and the inner sidewall of the diaphragm.

5. The microphone of claim 1, wherein the lower backplate has a lower hole passing therethrough, the upper backplate has an upper hole passing therethrough, and the upper hole is connected to the lower hole through the diaphragm hole.

6. The microphone of claim 1, a lower gap is defined between the lower backplate and the diaphragm and an upper gap is defined between the diaphragm and the upper backplate.

7. The microphone of claim 1, wherein the connection unit is disposed at a position that corresponds to a core of the lower backplate.

8. The microphone of claim 1, wherein the connection unit comprises a conductive material, and an insulation layer is disposed between the lower backplate and the connection unit or between the connection unit and the upper backplate.

9. The microphone of claim 1, wherein the connection unit comprises an insulating material.

10. The microphone of claim 1, wherein the acoustic chamber is recessed from a top surface of the substrate toward a bottom surface of the substrate, and a bottom surface of the acoustic chamber has a level greater than that of the substrate.

11. The microphone of claim 10, further comprising a support disposed on the bottom surface of the acoustic chamber to extend toward the top surface of the substrate, wherein the lower backplate is disposed on the support.

12. A microphone comprising:

a substrate comprising an acoustic chamber;

a lower backplate disposed on the substrate;

an insulation layer fully covering an upper surface of the lower backplate;

a diaphragm spaced apart from the insulation layer on the lower backplate, the diaphragm having a plurality of diaphragm holes passing therethrough;

an upper backplate disposed above the diaphragm so that the upper backplate is spaced apart from the diaphragm; and connection units disposed between the lower backplate and the upper backplate to respectively pass through the diaphragm holes, wherein the insulation layer is attached to the upper surface of the lower backplate.

13. The microphone of claim 12, wherein each of the connection units has a width less than a diameter of each of the diaphragm holes.

14. The microphone of claim 12, further comprising:

a diaphragm support part extending from the diaphragm toward a bottom surface of the substrate to contact the substrate; and an upper backplate support part extending from the upper backplate toward the bottom surface of the substrate to cover a portion of the top surface of the substrate, wherein the upper backplate support part is spaced apart from the diaphragm support part.

15. The microphone of claim 1, wherein the diaphragm is circular.

16. The microphone of claim 12, wherein the diaphragm is circular.

17. A microphone comprising:

a substrate comprising an acoustic chamber;

a lower backplate disposed on the substrate;

a diaphragm spaced apart from the lower backplate on the lower backplate, the diaphragm having a diaphragm hole passing through the diaphragm;

a connection unit disposed on the lower backplate and extending through the diaphragm hold; and an upper backplate disposed on the connection unit, the upper backplate being spaced apart from the diaphragm, wherein the connection unit fixes a distance between the lower backplate and the upper backplate.

* * * * *